United States Patent [19]

Hasegawa et al.

[11] Patent Number: 4,479,471

[45] Date of Patent: Oct. 30, 1984

[54] METHOD FOR CONTROLLING ENGINE IDLING RPM IMMEDIATELY AFTER THE START OF THE ENGINE

[75] Inventors: Shumpei Hasegawa, Niiza; Noriyuki Kishi, Itabashi; Takashi Koumura, Iruma, all of Japan

[73] Assignee: Honda Motor Co., Ltd., Tokyo, Japan

[21] Appl. No.: 491,208

[22] Filed: May 3, 1983

[30] Foreign Application Priority Data

May 8, 1982 [JP] Japan ..... 57-77250

[51] Int. Cl.[3] ..... F02D 9/02; F02D 31/00

[52] U.S. Cl. ..... 123/339; 123/588

[58] Field of Search ..... 123/179 G, 339, 585, 123/588

[56] References Cited

U.S. PATENT DOCUMENTS 3,964,457 6/1976 Coscia ..... 123/339 X
4,364,348 12/1982 Itoh et al. ..... 123/339
4,399,789 8/1983 Yano ..... 123/339 X
4,407,243 10/1983 Otsuka et al. ..... 123/585 X
4,414,943 11/1983 Nagase ..... 123/339

*Primary Examiner*—Tony M. Argenbright
*Attorney, Agent, or Firm*—Arthur L. Lessler

[57] ABSTRACT

An idling rpm control method for feedback control of a control valve for controlling the quantity of supplementary air being supplied to the engine in response to a difference between actual engine idling rpm and desired idling rpm. At the start of the engine, the control valve is continuously opened for a predetermined period of time from the time the engine rpm has increased above a predetermined value lower than the desired idling rpm, thereby maintaining the engine rpm at a value higher than the above desired idling rpm. The above predetermined period of time may desirably be set to a value as a function of engine temperature, preferably detected immediately after the engine rpm has exceeded the above predetermined value of engine rpm.

5 Claims, 24 Drawing Figures

INTERNAL COMBUSTION ENGINE
ELECTRONIC CONTROL UNIT
OTHER SENSORS
RPM SENSOR
TEMP. SENSOR
PRESS. SENSOR
THROTTLE SENSOR
#1 ELEC. DEVICE
#2 ELEC. DEVICE
#3 ELEC. DEVICE

METHOD FOR CONTROLLING ENGINE IDLING RPM IMMEDIATELY AFTER THE START OF THE ENGINE

BACKGROUND OF THE INVENTION

This invention relates to an idling rpm feedback control method for internal combustion engines, and more particularly to such method which allows the engine to perform stable idling operation immediately after the start of same.

In an internal combustion engine, the engine can easily stall due to a drop in the engine speed when the engine is operated in an idling condition at a low temperature of the engine cooling water or when the engine is heavily loaded with loads by head lamps, air conditioner, etc. in a vehicle equipped with the engine. To eliminate such disadvantage, an idling rpm feedback control method has been proposed e.g. by Japanese Patent Provisional Publication (Kokai) No. 55-98628, which comprises setting desired idling rpm in dependence upon engine load of the engine, detecting the difference between actual engine rpm and the desired idling rpm, and supplying a quantity of supplementary air to the engine in a manner responsive to the detected difference so as to minimize the same difference, to thereby control the engine rpm to the desired idling rpm.

Even if such idling rpm control method is applied, it is difficult to ensure complete combustion of the air/fuel mixture within the combustion chambers of the engine at or immediately after the start of the engine, especially in cold weather, due to low engine temperature, particularly, low temperature of the wall surfaces of the combustion chambers, causing unstable rotation of the engine at engine idle immediately following the start of the engine. Further, since immediately after the start of the engine the battery installed in the engine is charged by the dynamo or generator as it is used for actuating the starter during engine cranking, and the operating dynamo forms a heavy load on the engine, thereby further making the engine operation unstable.

On the other hand, when the engine is started while it has a high temperature, for instance, when it is restarted immediately after operation in hot weather, there can occur bubbles in pipes of the fuel feeding system of the engine due to high temperature. The presence of such bubbles also can result in very unstable rotation of the engine at engine idle, requiring prompt removal of such bubbles.

SUMMARY OF THE INVENTION

It is the object of the invention to provide an idling rpm control method which is adapted to maintain the engine rpm at a value higher than desired idling rpm for a predetermined period of time at engine idle immediately following the start of the engine, thereby ensuring highly stable idling operation of the engine.

The present invention provides an idling rpm feedback control method for controlling a control valve for regulating the quantity of supplementary air being supplied to an internal combustion engine, in a feedback manner responsive to the difference between actual engine rpm and desired idling rpm during idling of the engine. The method of the invention is characterized by the steps of: (a) detecting engine rpm at the start of the engine; and (b) opening the above control valve to a maximum opening for a predetermined period of time from the time the engine rpm is first detected to have increased above a predetermined value lower than the above desired idling rpm, whereby the engine rpm is maintained at a value higher than the desired idling rpm.

Preferably, the above predetermined period of time is set to a value as a function of the temperature of the engine, which is detected immediately after the engine rpm has increased above the above predetermined value. Preferably, the predetermined period of time is determined in either of the following manners: (i) setting the predetermined period of time to larger values as the engine temperature decreases below a predetermined value and further becomes lower; and (ii) setting the predetermined period of time to larger values as the engine temperature increases above a predetermined value and further becomes higher.

The above and other objects, features and advantages of the invention will be more apparent from the ensuing detailed description taken in conjunction with the accompanying drawings.

DETAILED DESCRIPTION

The method of the invention will be described in detail with reference to the accompanying drawings.

Figure 1:
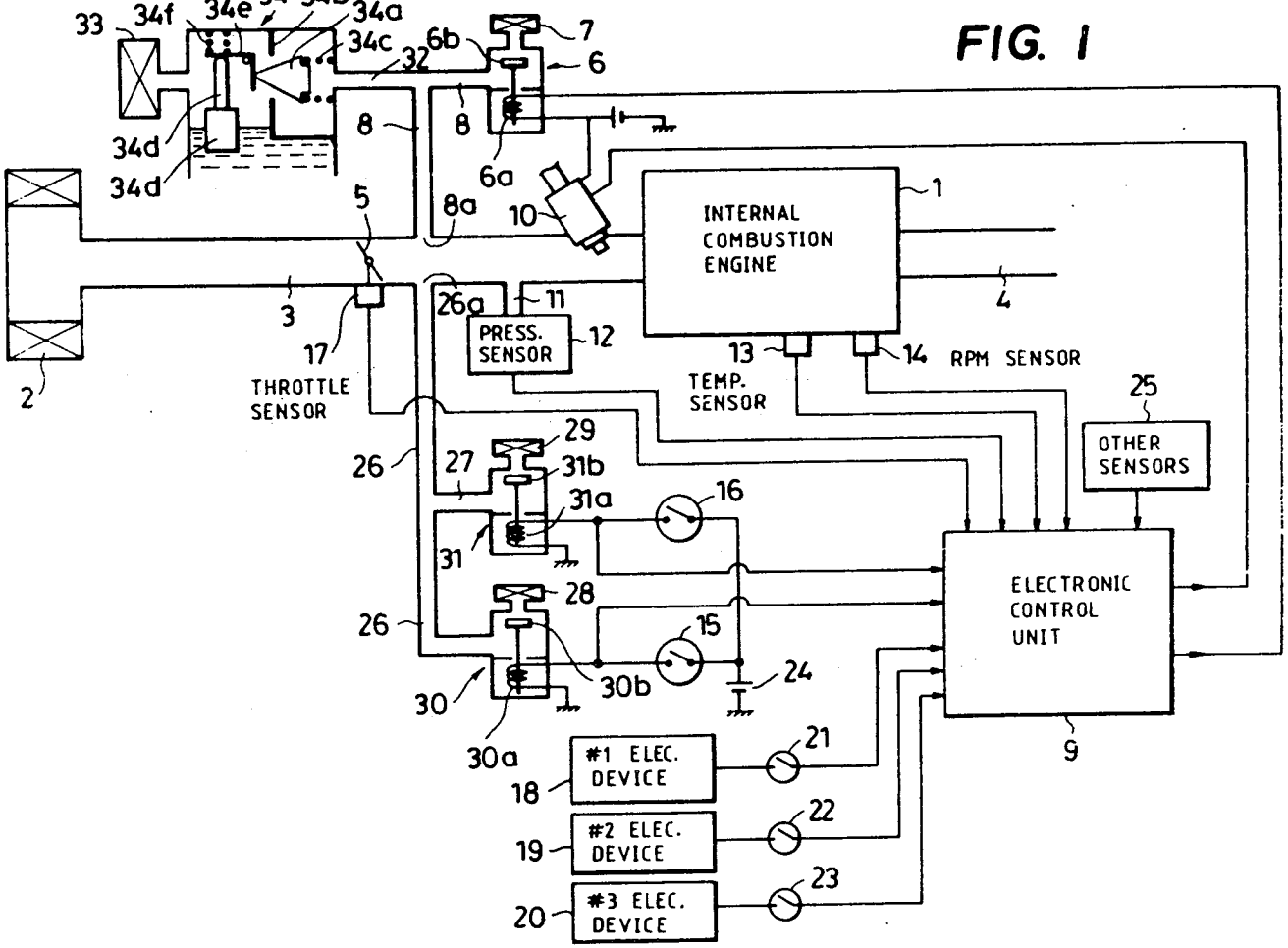
FIG. 1 is a block diagram illustrating the whole arrangement of an idling rpm control system to which is applicable the method of the present invention.

Referring first to FIG. 1, an idling rpm feedback control system is schematically illustrated, to which is applicable the method of the invention. In FIG. 1, reference numeral 1 designates an internal combustion engine which may be a four-cylinder type, and to which are connected an intake pipe 3 with an air cleaner mounted at its open end and an exhaust pipe 4, at an intake side and at an exhaust side of the engine 1, respectively. A throttle valve 5 is arranged within the intake pipe 3, and a first air passage 8 and a second air passage 26 open at their open ends 8*a* and 26*a* in the intake pipe 3 at locations downstream of the throttle valve 5 and communicate at the other ends with the atmosphere. An air cleaner 7 is mounted at the other end of the first air passage 8. Arranged across the first air passage 8 is a first supplementary air quantity control valve (hereinafter merely called "the first control valve") 6 which controls the quantity of supplementary air being supplied to the engine 1 through the first air passage 8. This first control valve 6 is a normally closed type and comprises a solenoid 6*a* and a valve body 6*b* disposed to open the first air passage 8 when the solenoid 6*a* is energized. The solenoid 6*a* is electrically connected to an electronic control unit (hereinafter called "the ECU") 9.

A third air passage 27 branches off from the second air passage 26, both of which have their atmosphere-opening ends provided with air cleaners 28 and 29. Second and third supplementary air control valves 30 and 31 are arranged, respectively, across a portion of the second air passage 26 between the junction of the same passage 26 with the third air passage 27 and its atmosphere-opening end and across the third air passage 27. The control valves 30, 31 are both a normally closed type and each comprise a solenoid 30*a*, 31*a*, and a valve body 30*b*, 31*b* disposed to open the corresponding air passage when the solenoid 30*a*, 31*a* is energized. The solenoids 30*a*, 30*b* have their one ends grounded and the other ends connected to a direct current power source 24, respectively, by way of switches 15 and 16, and directly to the ECU 9.

Connected to the above first air passage 8 is a branch passage 32 branching off therefrom at a location downstream of the first control valve 6, which has an end communicating with the atmosphere and provided with an air cleaner 33, and traversed by a fast idling control device 34. The fast idling control device 34 is comprised, for instance, of a valve body 34*a* disposed to be urged against its valve seat 34*b* by a spring 34*c* for closing the branch passage 32, a sensor means 34*d* adapted to stretch or contract its arm 34*d*' in response to the engine cooling water temperature, and a lever 34*e* pivotable in response to the stretching and contracting action of the arm 34*d*' of the sensor means 34*d* for displacing the valve body 34*a* so as to open or close the branch passage 32.

A fuel injection valve 10 is arranged in a manner projected into the interior of the intake pipe 3 at a location between the engine 1 and the open ends 8*a* and 26*a* of the first and second air passages 8, 26 opening in the intake pipe 3. The injection valve 10 is connected to a fuel pump, not shown, and also electrically connected to the ECU 9.

A throttle valve opening sensor 17 is mounted on the throttle valve 5, and an absolute pressure sensor 12 communicates with the intake pipe 3 through a conduit 11 at a location downstream of the open ends 8*a*, 26*a* of the first and second air passages 8, 26, while an engine cooling water temperature sensor 13 for detecting the engine cooling water temperature as representing the engine temperature, and an engine rpm sensor 14 are both mounted on the body of the engine 1. All the sensors and other sensors 25 for detecting other parameters of the operating conditions of the engine 1 are electrically connected to the ECU 9.

In FIG. 1, reference numerals 18, 19 and 20 designate electrical devices such as head lamps, a brake lamp and a radiator cooling fan, which are electrically connected to the ECU 9 by way of respective switches 21, 22 and 23. Reference numeral 25 denotes other engine parameter sensors such as an atmospheric pressure sensor, which are also electrically connected to the ECU 9.

The idling rpm feedback control system constructed as above operates as follows: The switch 15 is disposed for turning on and off in unison with a power switch, not shown, for actuating the air conditioner, not shown, and therefore when closed, its closing signal is supplied to the ECU as a signal indicative of an on-state of the air conditioner in the ECU 9. The closing of the switch 15 causes energization of the solenoid 30*a* of the second control valve 30 to open the valve body 30*b* for supplying the engine 1 with a predetermined quantity of supplementary air corresponding to an increase in the engine load caused by the operation of the air conditioner. The switch 16 is mounted, e.g. on a shift lever, not shown, if the present system is installed in an internal combustion engine equipped with an automatic transmission, and it is closed when the shift lever is moved to an engaging position of the automatic transmission, and supplies an on-state signal indicative of the engagement of the automatic transmission (hereinafter called "the D-range signal") to the ECU 9, and the closing of the switch 16 causes energization of the solenoid 31*a* of the third control valve 31 to open the valve body 31*b* for supplying the engine 1 with a predetermined quantity of supplementary air corresponding to increased engine load caused by the operation of the automatic transmission.

Thus, accurate control of the engine rpm can be achieved with ease due to the provision of the second and third control valves for supplying supplementary air to the engine 1 in quantities corresponding to mechanical loads, which are relatively large, applied by mechanical equipments directly driven by the engine, such as the air conditioner and the automatic transmission.

The fast idling control device 34 is adapted to operate when the engine cooling water temperature is lower than a predetermined value (e.g. 20° C.) such as at the start of the engine in cold weather. More specifically, the sensor means 34*d* stretches or contracts its arm 34*d*' in response to the engine cooling water temperature. This sensor means 34*d* may comprise any suitable sensing means, such as wax filled within a casing, which is thermally expandable. When the engine cooling water temperature is lower than the above predetermined value, the arm 34*d*' is in a contracted state, with the level 34*e* biased by the force of the spring 34*f* in such a position to displace the valve body 34*a* in a rightward direction against the force of the spring 34*c* whereby the branch passage 32 is opened. Since the opened branch passage 32 allows supply of a sufficient amount of supplementary air to the engine through the filter 33 and the passages 32, 8, the engine rpm can be maintained at a higher value than normal idling rpm, thereby ensuring stable idling operation of the engine without the possibility of engine stall even in cold weather. Therefore, when the fast idling control device 34 is operative, the supply of supplementary air through the first control valve 6, hereinafter described, is not necessary in addition to that effected through the fast idling control device 34. Thus, the first control valve 6 is kept inoperative until the engine cooling water temperature becomes higher than a predetermined value except for a predetermined period of time immediately after the start of the engine, hereinafter referred to.

As the arm 34*d*' of the sensor means 34*d* is stretched with an increase in the engine cooling water temperature, it pushes the lever 34*e* upward to rotate same in a clockwise direction. Then, the valve body 34*a* becomes moved leftward as viewed in FIG. 1, rather by the force of the spring 34*c*. When the engine cooling water temperature exceeds the predetermined value, the valve body 34*a* comes into urging contact with the valve seat 34*b* to close the branch passage 32, thereby interrupting the supply of supplementary air through the fast idling control device 34.

The above fast idling control device may have another arrangement other than the illustrated one, so far as it can increase the intake air quantity being supplied to the engine 1 so as to maintain the engine rpm at a value higher than normal idling rpm at engine idle, when the engine cooling water temperature is lower than a predetermined value. For instance, it may be adapted to force the throttle valve to open to a certain opening.

On the other hand, the first control valve 6 is used for feedback control of the supplementary air quantity wherein the same quantity is varied so as to maintain the engine rpm at desired idling rpm. Also, it is used for increasing the supplementary air by a predetermined amount corresponding to electrical load on the engine, which is relatively small, when an electrical equipment such as headlamps, a brake lamp and a radiator cooling fan is switched on.

The ECU 9 determines the operating conditions and loaded conditions of the engine 1 in dependence on values of signals indicative of engine operating condition parameters supplied from the throttle valve opening sensor 17, the absolute pressure sensor 12, the engine cooling water temperature sensor 13, the engine rpm sensor 14, and the other engine operation parameter sensors 25, signals indicative of electrical loads from the electrical devices 18, 19, 20, an on-state signal from the air conditioner, and the D-range signal from the automatic transmission. The ECU 9 calculates a desired quantity of fuel to be supplied to the engine 1, that is, a desired valve opening period of the fuel injection valve 10, and also a desired quantity of supplementary air to be supplied to the engine 1, that is, a desired valve opening period of the first control valve 6, on the basis of the determined operating conditions of the engine and electrical loads on the engine, and then supplies driving pulses corresponding to the calculated values to the fuel injection valve 10 and the first control valve 6. The valve opening period of the first control valve 6 is determined by the ratio of the on-state period to the pulse separation of a pulse signal synchronous with the rotation of the engine 1, e.g. a pulse signal having each pulse generated at a predetermined crank angle of the engine 1 (hereinafter called "duty ratio").

The first control valve 6 has its solenoid 6*a* energized by each of its driving pulses to open the first air passage 8 for a period of time corresponding to its calculated valve opening period so that a quantity of supplementary air corresponding to the calculated valve opening value is supplied to the engine through the first air passage 8 and the intake pipe 3.

The fuel injection valve 10 is energized by each of its driving pulses to open for a period of time corresponding to its calculated valve opening period value to inject fuel into the intake pipe 3 so as to achieve a desired air-fuel ratio of the mixture being supplied to the engine 1. As described in detail later, the valve opening period of the fuel injection valve 10 is increased or decreased by a predetermined amount a predetermined number of times in dependence on electrical load signals from the electrical devices 18, 19 and 20, on-state signal from the air conditioner, and the D-range signal from the automatic transmission, and after the lapse of a predetermined period of time from the inputting of these signals to the ECU 9, thereby compensating for lag of the detection of the supplementary air quantity to ensure supply of an appropriate amount of fuel corresponding to a change in the supplementary air quantity to the engine 1.

Figure 2:
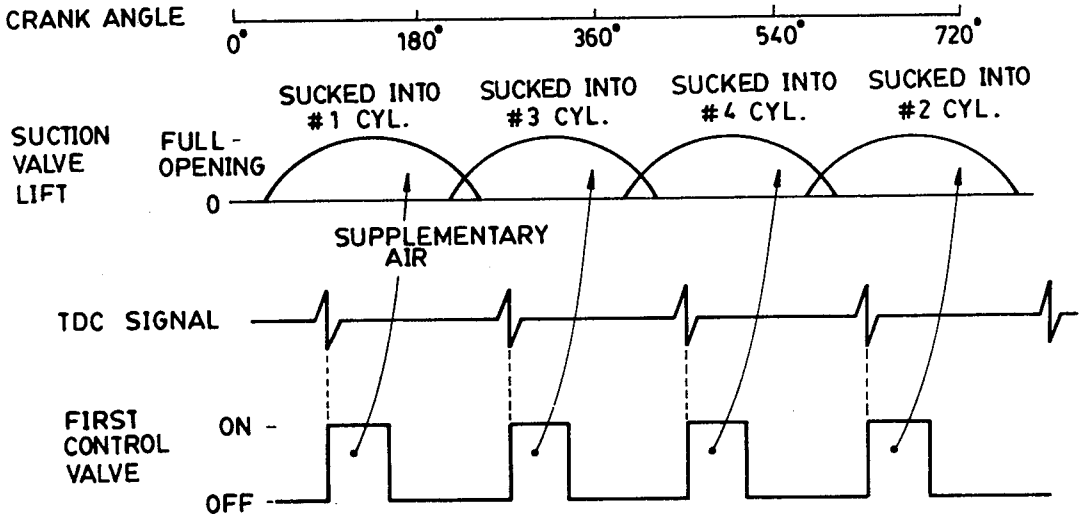
FIG. 2 is a timing chart showing a manner of supplying the supplementary air to the engine in synchronism with generation of pulses of an engine top-dead-center (TDC) signal.

Next, a basic manner of supplying the supplementary air through the first control valve 6 will now be described with reference to FIGS. 2 through 5. Referring first to FIG. 2, the first control valve 6 is opened in synchronism with generation of each pulse of the TDC signal at each suction stroke of each cylinder of the engine. It should be noted that according to the manner shown in FIG. 2, the first control valve 6 is opened only one time each time a pulse of the TDC signal is generated, that is, each time the engine goes through each suction stroke. This manner reduces the frequency of opening and closing the first control valve to thereby lengthen the effective life of the first control valve 6.

Figure 3:
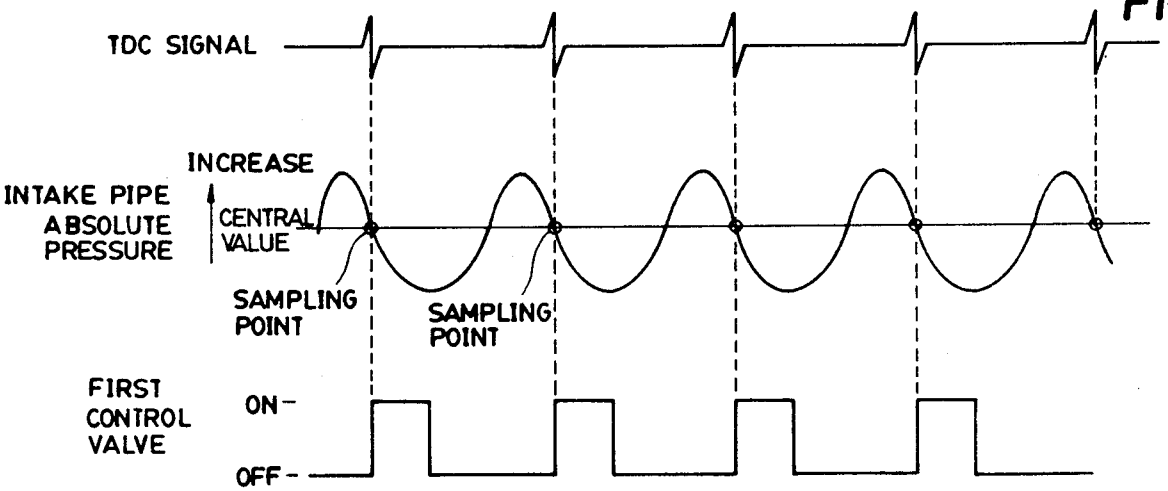
FIG. 3 is a timing chart showing a manner of detecting a parameter indicative of the intake air quantity.
Figure 4:
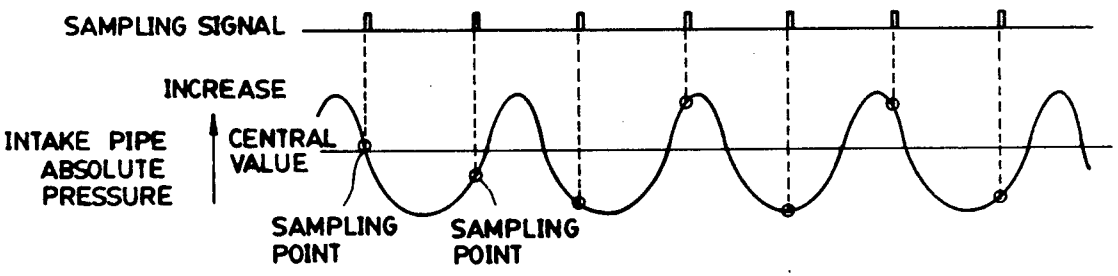
FIG. 4 is a timing chart showing a manner of detecting the intake air quantity parameter with time intervals optionally determined.

FIG. 3 shows a manner of detecting absolute pressure in the intake pipe of the engine as a parameter representative of the total quantity of suction air being supplied to the engine, which is also applicable to the system of the invention, and FIG. 4 shows a manner of detecting the intake pipe absolute pressure at a constant time interval optionally selected, irrespective of fluctuations in the intake pipe absolute pressure. According to the manner of FIG. 4, the intake pipe absolute pressure is detected in synchronism with generation of a sampling signal having a constant pulse repetition period. The sampling signal cannot correspond in phase to fluctuations in the intake pipe absolute pressure, making it impossible to detect a central value of the intake pipe absolute pressure which is correctly indicative of the actual total quantity of the suction air. On the other hand, if the first control valve 6 is operated in synchronism with generation of the TDC signal for controlling the supply of supplementary air, as shown in FIG. 2, the fluctuations of the intake pipe absolute pressure nearly correspond in repetition period to the TDC signal, as shown in FIG. 3. Taking this fact into account, the intake pipe absolute pressure should be detected in synchronism with generation of the TDC signal, that is, at a substantially constant phase point of the fluctuation waves of the intake pipe absolute pressure, thus obtaining central values of the same pressure exactly corresponding to actual total suction air quantities. In this way, proper amounts of fuel can be supplied to the engine, which exactly correspond to actual total suction air quantities, preventing unstable idling operation of the engine which would otherwise be caused by fluctuations in the fuel supply quantity.

Figure 5:
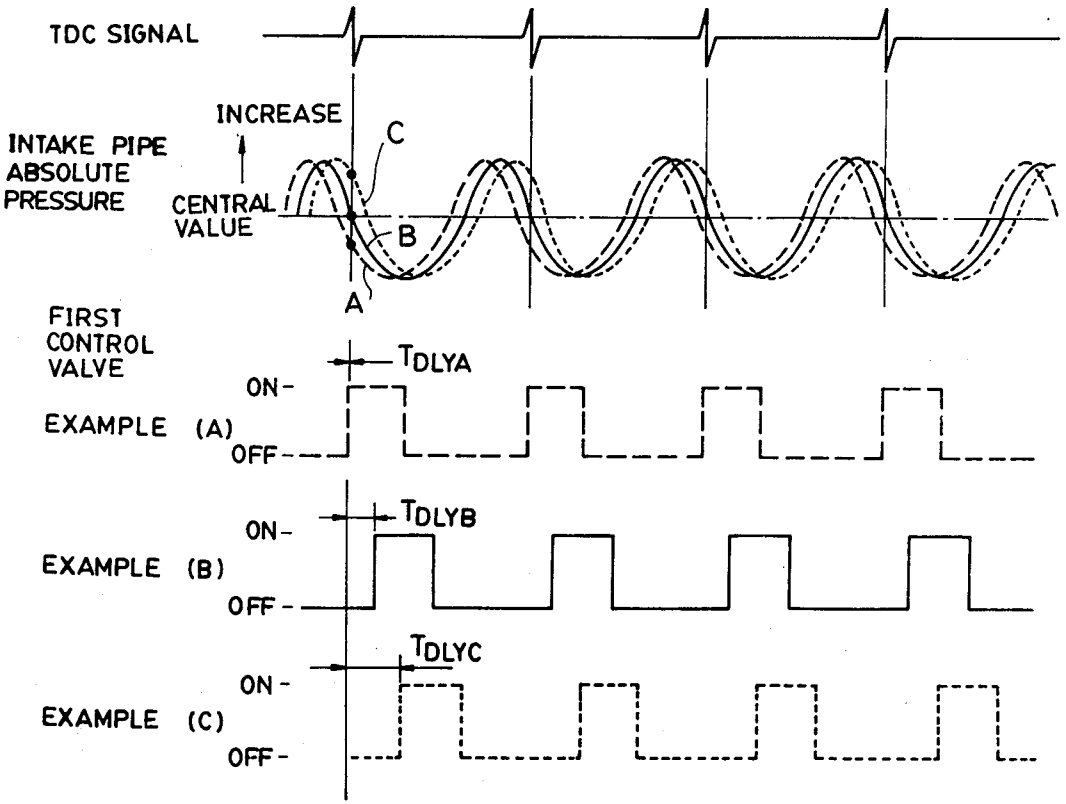
FIG. 5 is a timing chart showing a manner of supplying the supplementary air with a time delay with respect to generation of pulses of the TDC signal.

Further, when supplementary air is supplied to the engine, the cycle of fluctuations of the intake pipe absolute pressure can deviate in phase from generation of pulses of the TDC signal, depending upon the timing of initiation of the opening of the first control valve 6, that is, the timing of initiation of the supply of supplementary air, which causes variations in the timing of obtaining central values of the intake pipe absolute pressure exactly corresponding to the total suction air quantities. If the intake pipe absolute pressure is detected always at a constant time with respect to generation of the TDC signal pulses, irrespective of such phase deviation of the fluctuations of the intake pipe absolute pressure, actually detected values of the intake pipe absolute pressure can be higher or lower than respective central values of same, due to the above phase deviation. FIG. 5 shows manners of detecting the intake pipe absolute pressure, in which the same pressure is detected just upon generation of each pulse of the TDC signal. According to the engine to which the manners of FIG. 5 are applied, if the first control valve 6 is opened upon a lapse of an optional period of time TDLY C after generation of each TDC signal pulse as shown in the example C in FIG. 5, the resulting detected value of the intake pipe absolute pressure is higher than the actual central value, and as a consequence the system judges that suction air has been supplied to the engine in more quantities than the actual quantities, and accordingly supplies the engine with larger quantities of fuel than actually required, resulting in a too rich mixture being supplied to the engine. On the contrary, if the first control valve 6 is opened immediately upon generation of each TDC signal pulse as in the example A, the resulting detected value of the intake pipe absolute pressure is lower than the actual central value, resulting in a too lean mixture being supplied to the engine. In view of the above disadvantages, as shown in the example B in FIG. 5, the value of a predetermined delay coefficient should be determined in dependence upon the configuration of the intake pipe of the engine applied, and the timing of opening of the first control valve 6, i.e. the timing of supply of supplementary air should be delayed by a period of time TDLY B corresponding to the determined coefficient value with respect to generation of each TDC signal pulse so as to always make the phase of the fluctuating cycle of the intake pipe absolute pressure constant relative to the timing of generation of the TDC signal pulses, thus making it possible to positively detect central values of the absolute pressure. In this manner, fuel can be always supplied to the engine in proper quantities exactly corresponding to quantities of supplementary air, for instance, in quantities corresponding to a theoretical air/fuel ratio, to ensure accurate and stable control of the idling rpm of the engine.

Figure 6A:
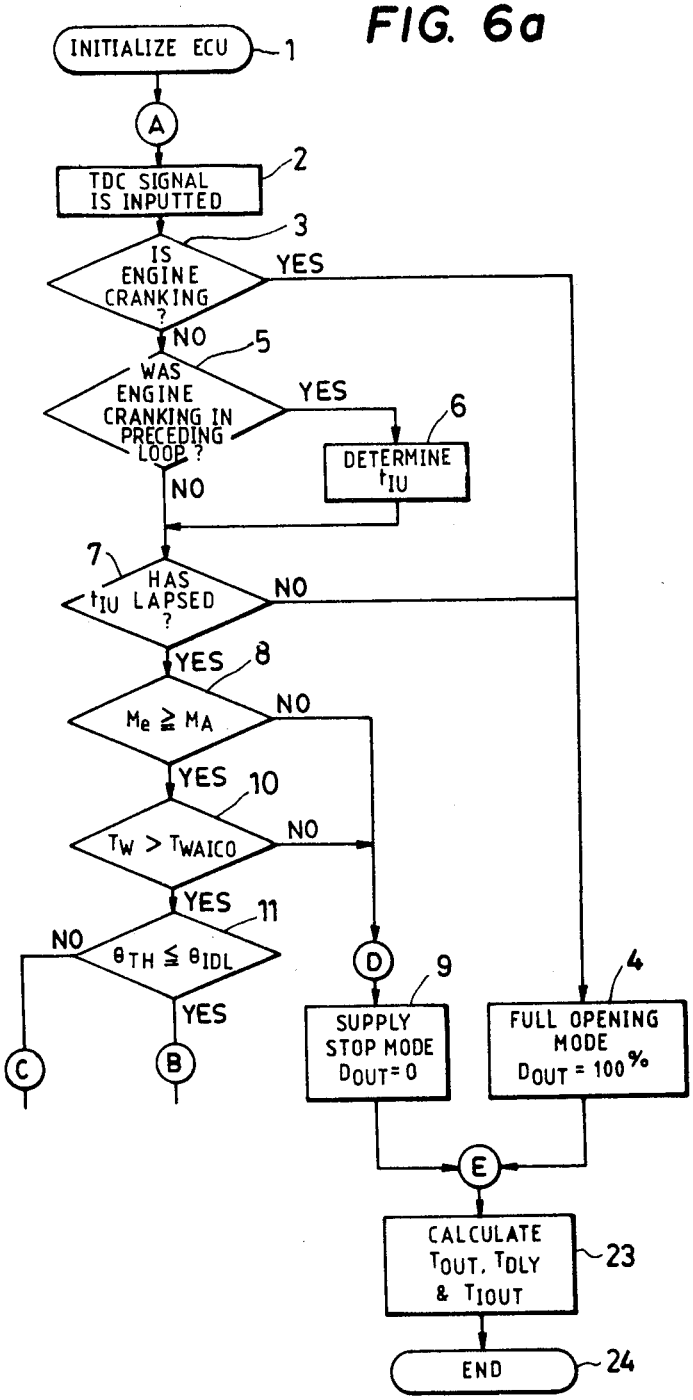
FIGS 6*a*, 6*b*, and 6*c* are a flow chart showing a program for performing an idling rpm control method by means of a first control valve, executed within an electronic control unit (ECU) in FIG. 1.
Figure 6B:
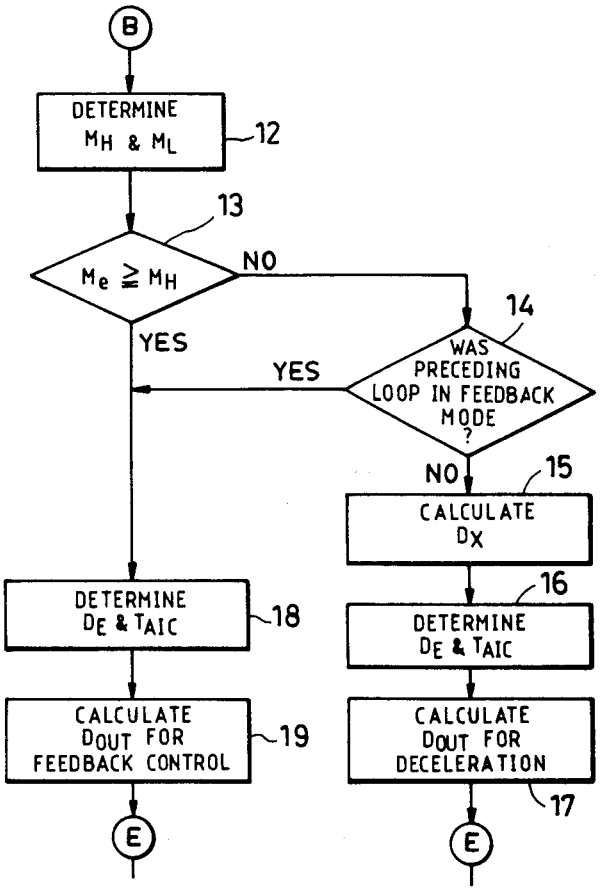
Figure 6C:
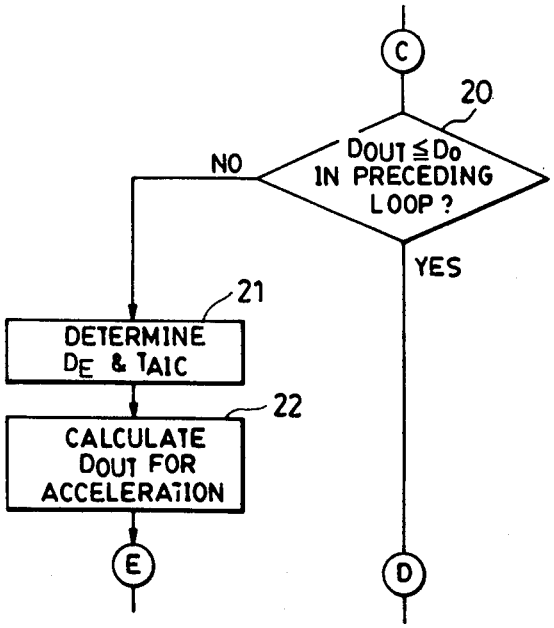

FIGS. 6 shows flow charts for a routine for control of the first control valve 6, executed within the ECU 9 in FIG. 1.

The present program is executed in sychronism with generation of the TDC signal, and initiated after the ignition switch, not shown, is turned on to initialize the ECU 9 (step 1 of (a) of FIG. 6). When the TDC signal from the engine rpm sensor 14 in FIG. 1 is inputted to the ECU 9 (step 2), it is first determined whether or not the engine rpm Ne is lower than cranking rpm NeCR (e.g. 400 rpm) and whether or not the engine starter switch is in an on-state, at the step 3. If the answer to this question is yes, that is, the engine is determined to be cranking, the duty factor DOUT for the valve opening period of the first control valve 6 is set to 100 percent so as to supply a maximum amount of supplementary air to the engine 1, thereby obtaining stable starting of the engine and allowing the engine rpm to reach the idling rpm promptly (step 4). This duty factor setting is called "full opening mode control". If the answer to the question of the step 3 is no, the program proceeds to the steps 5 through 7. These steps 5 through 7 are in accordance with the manner of control of the first control valve 6 according to this invention, hereinafter described in detail, wherein the duty factor DOUT for the valve opening period of the first control valve 6 is continued to be set to 100 percent for a period of time tIU which is determined by the engine cooling water temperature, immediately after completion of the engine cranking, that is, immediately after the engine rpm Ne has risen above the cranking rpm NeCR or the engine starter switch has been turned off from an on-state.

Upon determination of the lapse of the predetermined period of time tIU from the completion of the engine cranking at the step 7, the program proceeds to the step 8, where it is determined whether or not a value Me proportional to the reciprocal of the engine rpm Ne is larger than a value MA proportional to the reciprocal of a predetermined value NA (e.g. 1,500 rpm) larger than desired idling rpm. The above reciprocal values Me, MA are applied for the convenience of processing within the ECU 9, and represent the time interval between adjacent pulses of a pulse signal generated in synchronism with the rotation of the engine. That is, the higher the engine rpm, the smaller the time interval becomes.

If the answer to the question of the step 8 is no (Me<MA), that is, the engine rpm Ne is higher than the predetermined rpm NA, the ECU 9 sets the duty factor DOUT to zero at the step 9, so as to interrupt the supply of any control signal for the first control valve 6 to fully close same, because on such occasion the supply of supplementary air to the engine 1 is not necessary as there is no possibility of engine stall and fluctuations in the engine rotation. This setting of the duty factor is hereinafter called "supply stop mode control". Since the first control valve 6 is thus deenergized when no supply of supplementary air is required, the solenoid **6*a* will not overheat and repeated on-off actions of the valve body 6*b* can be avoided to lengthen the effective life of the valve 6**.

If the answer to the question of the step 8 is yes, (Me≧MA), that is, when the engine rpm Ne is still lower than or equal to the predetermined rpm NA, the program proceeds to the next step 10, where it is determined whether or not the engine cooling water temperature TW is higher than a predetermined value TWAIC0 (e.g. 50° C.). If the result of determination of the step 10 gives a negative answer, that is, when the engine cooling water temperature TW is lower than or equal to the predetermined value TWAIC0, the fast idling control device 34 in FIG. 1 is then already operating as previously stated, and accordingly no supply of supplementary air to the engine through the first control valve 6 is necessary in addition to the supply of the same air through the fast idling control device 34. Therefore, the duty factor DOUT for the valve opening period of the first control valve 6 is set to zero, at the step 9, rendering the first control valve 6 inoperative.

If the result of the determination of the step 10 gives an affirmative answer, it is then determined at the next step 11 whether or not the valve opening $\theta$th of the throttle valve 5 in FIG. 1 is smaller than a predetermined value $\theta$IDL which is so small as can be substantially regarded as zero. If the answer to the question of the step 11 is yes, the program proceeds to the step 12 ((b) of FIG. 6), where values MH and ML are determined, which correspond, respectively, to the reciprocal of an upper limit NH of a desired idling rpm range and the reciprocal of a lower limit NL of same, in a manner hereinafter described in detail. Following this, a determination is made as to whether or not the value Me corresponding to the reciprocal of engine rpm Ne is larger than the value MH, at the step 13. If the result of this determination gives a negative answer (Me<MH), that is, when the engine rpm Ne is larger than the upper limit NH of the desired idling rpm range, it is then determined whether or not the preceding loop of the program was in feedback mode, at the step 14. If the answer is no, it is regarded that the engine is operating in decelerating mode, and the program proceeds to the steps 15 through 17 wherein the valve opening duty factor for the first control valve 6 is calculated, as hereinafter referred to. More specifically, at the step 15, a term DX of the duty factor DOUT (hereinafter called "decelerating mode term") is calculated so as to gradually increase with a reduction in the engine rpm, while at the step 16, another term DE of the duty factor DOUT (hereinafter called "electrical load term") is determined in dependence on the electrical load on the engine. Thereafter, at the step 17, the sum of the two terms DX and DE is calculated to obtain the value of the valve opening duty factor DOUT. At the step 16, a further determination is made of the value of a constant TAIC to be added to or subtracted from the valve opening period of the fuel injection valve predetermined times of injection after there occurs a change in the electrical load on the engine, as also hereinafter described in detail.

If the answer to the step 13 becomes affirmative (Me≧MH), that is, when the engine rpm Ne becomes smaller than or equal to the upper limit NH of the desired idling rpm range, the program proceeds to feedback mode control at engine idle, as hereinafter referred to, wherein the value of the constant TAIC is determined at the step 18, and further, calculation of the duty factor DOUT is carried out by adding the aforementioned electrical load term DE to a feedback mode control term DPIN, at the step 19. Even if the result of the determination of the step 14 gives an affirmative answer, the program proceeds to the steps 18 and 19 to carry out the feedback mode control of the valve opening period of the first control valve 6. This means that even in the event of the engine rpm jumping over the upper limit NH of the desired idling rpm range, the feedback mode control is continued so far as the preceding loop was in the same feedback mode and the throttle valve 5 remains fully closed.

When the throttle valve 5 is opened from its fully closed state during the feedback mode control, the result of the determination of the step 11 in (a) of FIG. 6 will give a negative answer or no, that is, as hereinafter described in detail, it is regarded that the engine has entered the accelerating mode region, and following a determination at the step 20, hereinafter referred to, determinations are made of the values of the electrical load term DE and the constant TAIC at the step 21, and then at the step 22, the value of the valve opening duty factor DOUT is determined which correponds to the sum of the determined values DE, TAIC and also an acceleration mode term which gradually decreases in value with an increase in the engine rpm during accelerating mode control.

At the step 20, it is determined whether or not the valve opening duty factor DOUT is smaller than a fine value Do with which the valve body **6*b* of the first control valve 6 will not substantially open even if the solenoid 6*a* of the same valve is energized (hereinafter called "ineffective duty factor value"). During accelerating mode control, with an increase in the engine rpm, the duty factor DOUT is reduced and finally even to the ineffective duty factor value Do, to establish the relationship of DOUT≦Do at the step 20. After this, the duty factor DOUT is set to zero, at the step 9 of (a) of FIG. 6, deenergizing the solenoid 6*a* of the first control valve 6** to render the valve inoperative.

After completion of the calculations of the duty factor DOUT for the valve opening period of the first control valve 6 in accordance with various operating conditions of the engine, the program proceeds to the step 23 in (a) of FIG. 6, wherein calculations are made of the valve opening period TOUT for the first control valve 6, the valve opening delaying period of time TDLY, already referred to with reference to FIG. 5, and the valve opening period TIOUT for the fuel injection valve 10, followed by termination of execution of the present program at the step 24.

Figure 7:
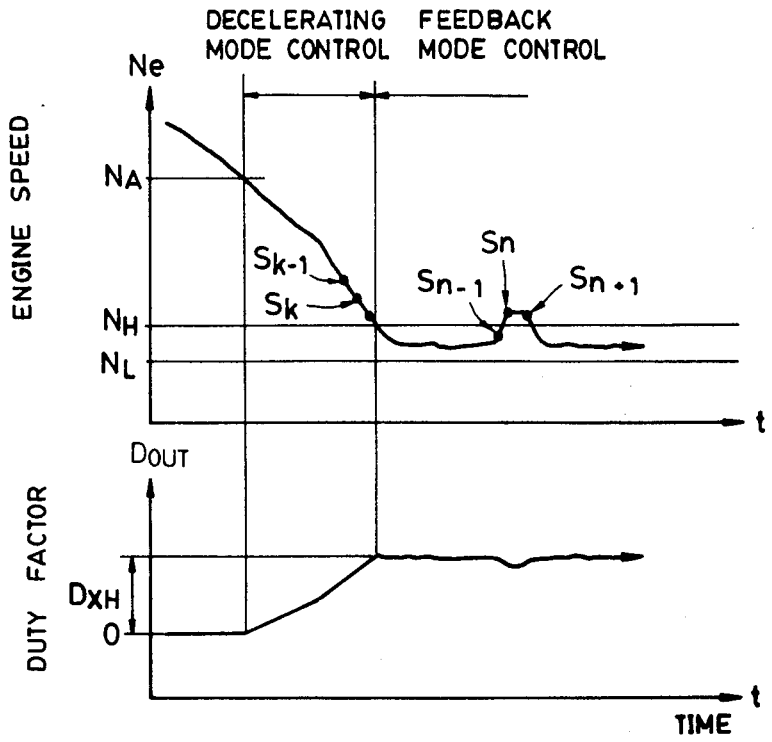
FIG. 7 is a timing chart showing a manner of control of the first control valve in decelerating mode and in feedback mode.
Figure 8:
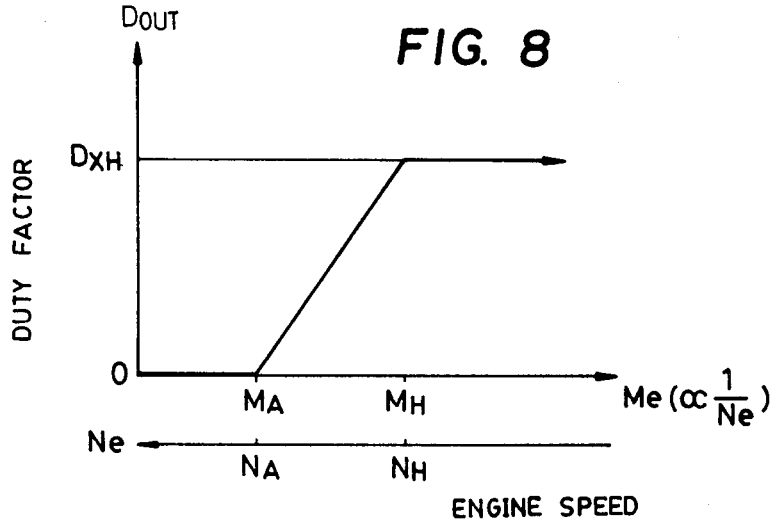
FIG. 8 is a graph showing, by way of example, the relationship between the duty factor for the valve opening period of the first control valve in decelerating mode and the engine rpm.
Figure 9:
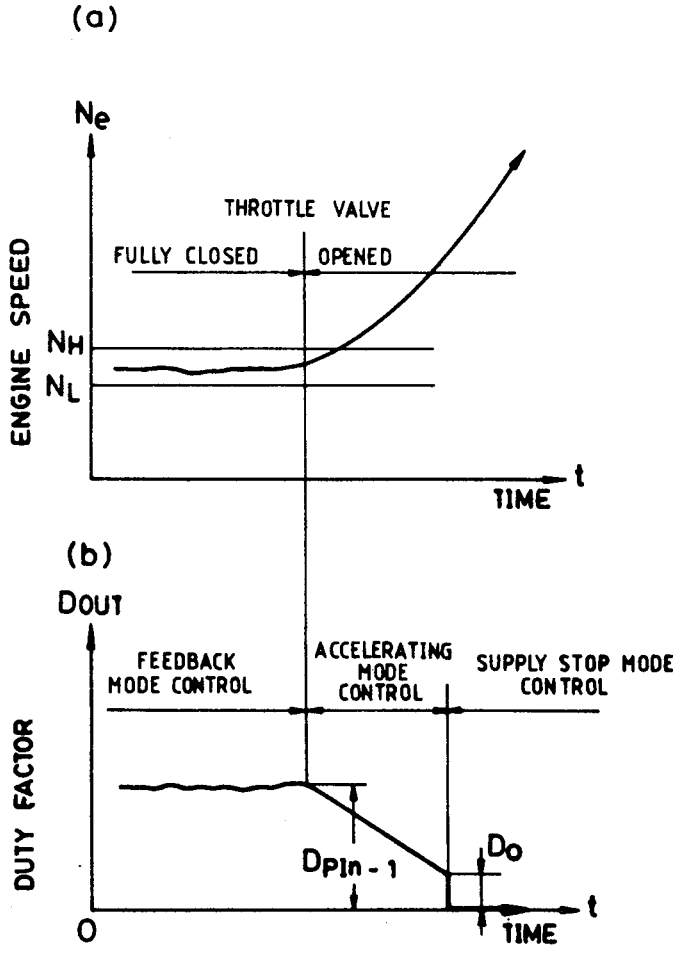
FIG. 9 is a timing chart showing a manner of control of the first control valve in accelerating mode.

FIGS. 7 through 9 show manners of controlling the valve opening period for the first control valve 6, respectively, in decelerating mode, feedback mode, and accelerating mode, already explained with reference to FIG. 6.

Control of First Control Valve in Decelerating Mode

As shown in FIG. 7, when the throttle valve 5 is fully closed to decelerate the engine so that the engine speed decreases with the lapse of time and below the aforementioned predetermined value NA (e.g. 1,500 rpm) ((a) of FIG. 7), the first control valve 6 is opened to allow supply of the supplementary air to the engine 1 through the first air passage 8 to initiate control of the supplementary air quantity in decelerating mode.

In this decelerating mode, the supplementary air quantity or the valve opening duty factor of the first control valve 6 is set so as to increase with a decrease in the engine rpm, and it is controlled to a predetermined duty factor DXH when the engine speed Ne decreases to the upper limit NH of the desired idling rpm range, as shown in FIG. 7. FIG. 8 shows an example of the relationship between the duty factor DX for the first control valve 6 and the engine rpm, applicable during the decelerating mode control. As shown in the graph, when the engine rpm Ne lies between the predetermined rpm NA and the upper limit NH of the desired idling rpm range, the duty factor DX is set to a value variable with a change in the value Me proportional to the reciprocal of the engine rpm Ne. When the value of engine rpm Ne is larger than or equal to the predetermined value NA ($Me \leqq MA$), the value DX is set to zero, while when the value of engine rpm is smaller than or equal to the value NH ($Me \geqq MH$), the value DX is set to the predetermined fixed value DXH.

In the above described manner, by gradually increasing the quantity of supplementary air with a decrease in the engine rpm from the predetermined value NA during engine deceleration with the throttle valve fully closed, the phenomenon can be prevented that the engine speed suddenly drops upon disengagement of the engine clutch during the engine deceleration, causing engine stall.

As previously explained with reference to the steps 15 through 17 of (b) of FIG. 6, during the decelerating mode control the duty factor for the valve opening period of the first control valve 6 is given by the sum of the decelerating mode term DX and the electrical load term DE. Although the foregoing description referring to FIG. 7 is based upon the omission of the electrical load term DE, a similar control manner in which the same term is applied as well, will be hereinafter described.

Control of First Control Valve in Feedback Mode

When the engine speed further decreases below the upper limit NH of the desired idling rpm range, the supplementary air quantity is now controlled in feedback mode so as to maintain the engine rpm Ne between the upper limit NH and the lower NL of the desired idling rpm range. These upper and lower limits of the desired idling rpm range are provided for stable control of the idling rpm. They are set at values higher and lower by a predetermined rpm value (e.g. 30 rpm) than a central value of the desired idling rpm range which is set to a value appropriate to the engine operation in dependence upon engine cooling water temperature, electrical loads of the electrical devices 18, 19, 20, etc. or mechanical loads of the mechanical load creating devices in the engine such as the air conditioner, each time there occurs a change in any of these parameters. When the actual engine speed lies between the upper limit NH and the lower limit NL, the ECU 9 regards that the engine rpm is equal to the desired idling rpm.

The idling rpm feedback control in feedback mode is carried out as follows: The ECU 9 detects the difference between the upper or lower limit NH or NL of the desired idling rpm range set to a value depending upon engine load as previously mentioned, and the actual engine rpm Ne obtained by the engine rpm sensor 14, sets the duty factor for the valve opening period of the first control valve 6 to such a value as corresponds to the detected difference and makes the same difference zero, and opens the control valve 6 for a period of time corresponding to the set duty factor to control the supplementary air quantity, thereby controlling the engine rpm to a value between the upper and lower limits NH and NL, i.e. the desired engine rpm.

During the above feedback control of the supplementary air quantity at engine idle, the engine speed can temporarily rise above the upper desired rpm limit NH, due to external disturbances or extinction of the engine load caused by switching-off of the electric devices 15, as indicated by the symbol Sn in FIG. 7. In such event, the ECU 9 determines whether or not control of the supplementary air quantity in the preceding loop was effected in feedback mode. This determination is provided to ensure continuation of the idling rpm feedback control without being affected by disturbances in the engine rpm caused by external disturbances etc. once the same feedback control has been initiated. In the example of FIG. 6, it is noted that the preceding loop $Sn-1$ was in feedback mode. Therefore, the feedback control is continued also in the present loop Sn. Further, in the FIG. 6 example, it will be also determined by the ECU 9 that the present loop Sn is in feedback mode if the engine speed still exceeds the upper limit NH in the next loop $Sn+1$ as in the same example, and the feedback control will be continued also in the next loop. In this manner, once the feedback control has been started immediately after termination of the decelerating mode control, the same feedback control is continuously effected so long as the throttle valve 5 is kept closed, even if the engine speed temporarily rises above the upper limit NH due to external disturbances, to thereby achieve stable idling rpm feedback control.

On the other hand, during the control in decelerating mode, so long as the engine speed remains above the upper limit NH as indicated by the symbol Sk in FIG. 6, the ECU 9 determines whether or not the preceding loop $Sk-1$ was in decelerating mode, and continues the decelerating mode control also in the present loop Sk if the preceding loop was in decelerating mode. This makes it possible to avoid that the ECU 9 wrongly judges that the engine is in a feedback-mode controlling region, though in fact the engine is still in a decelerating-mode controlling region with the engine rpm above the upper idling rpm limit NH, and also that the valve opening period of the first control valve 6 is controlled to an extremely small value when the feedback control is erroneously carried out due to the above misjudgement, causing engine stall upon disengagement of the clutch.

Also when the engine rpm Ne drops below the lower limit NL, the difference between the same lower limit NL and the actual engine rpm Ne is determined, on the basis of which is determined the duty factor for the valve opening period of the first control valve 6 so as to increase the actual engine rpm Ne with an increase in the above difference.

The manner of setting the duty factor for the valve opening period of the first control valve 6 in feedback mode will be hereinafter described in detail.

Control of First Control Valve in Accelerating Mode

When the throttle valve 5 is opened for starting the vehicle during the feedback control of the idling engine rpm, the engine rpm Ne increases as shown in (a) of FIG. 9. Even with the throttle valve 5 thus opened, the supplementary air quantity is not suddenly reduced to zero, but the supplementary air is continuously supplied to the engine in a quantity equal to that applied during the feedback mode control immediately preceding the opening of the throttle valve 5, and thereafter the same supplementary air quantity is reduced by a predetermined amount, for instance, each time each pulse of the TDC signal is inputted to the ECU 9, as shown as accelerating mode in (b) of FIG. 9. This manner of controlling the supplementary air quantity can prevent a sudden drop in the engine speed and permit smooth engagement of the clutch without occurrence of engine stall.

During the accelerating mode control, the duty factor DOUT for the valve opening period of the first control valve 6 gradually decreases with an increase in the engine speed, and even reaches the fine ineffective duty factor value Do at which the valve body **6*b* of the first control valve 6 will not assume a substantially opened position even with the solenoid 6*a* energized. Once this ineffective duty factor value Do is reached, the duty factor DOUT is set to zero, as supply stop mode in (b) of FIG. 9, whereby the solenoid 6*a* of the first control valve 6 is deenergized to render the same valve inoperative, thereby improving the effective life of the valve body 6*b* and preventing overheating of the solenoid 6*a*** and any other adverse influence derived therefrom.

Setting of Upper and Lower Limits of Desired Idling RPM Range

Reference is now made to the manners of setting the values of MH and ML corresponding to the reciprocals of the upper and lower limits NH and NL of the desired idling rpm range, which are determined at the step 12 in (b) of FIG. 6.

The value of engine rpm that is desired at engine idle is determined in dependence on an engine temperature-indicative signal from the engine cooling water temperature sensor 13, signals indicative of various electrical loads from the switches 21, 22 and 23 of the electrical devices 18, 19 and 20 such as head lamps, and an on-off state signal from the air conditioner, and a D-range signal from the automatic transmission, all the signals being supplied to the ECU 9 in FIG. 1. However, in the following explanation, it is assumed for the convenience of explanation that the desired value of idling rpm is set in dependence on the engine cooling water temperature signal, the on-off state signal from the air conditioner and the D-range signal from the automatic transmission, alone.

Figure 10:
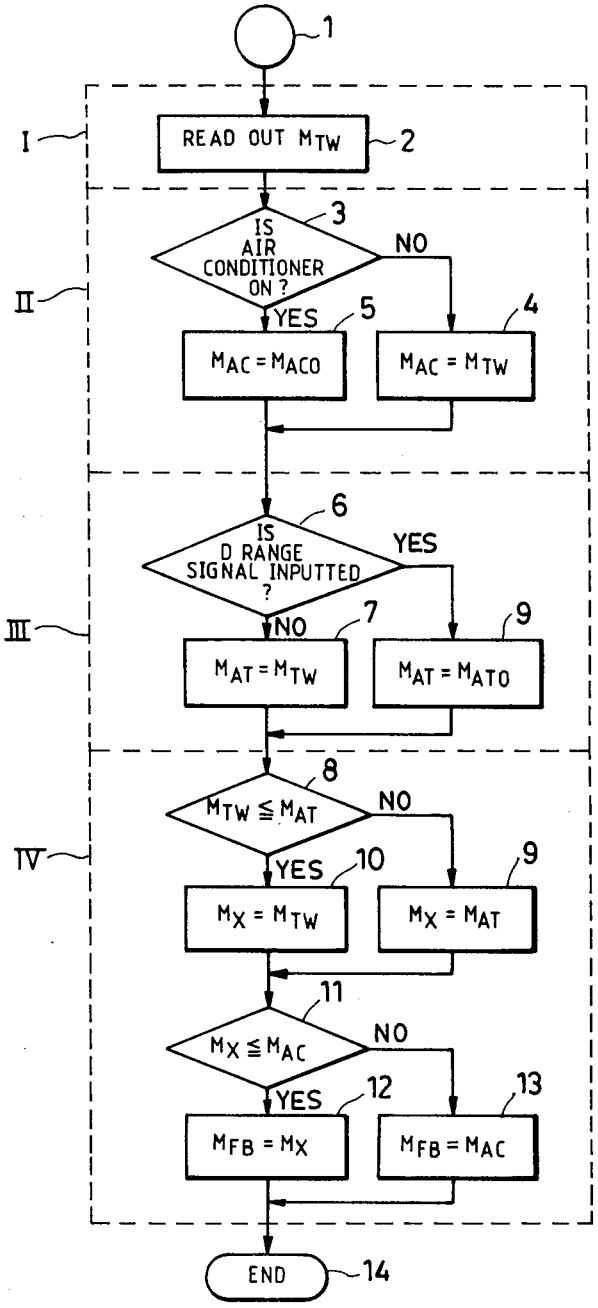
FIG. 10 is a flow chart showing a manner of setting the desired idling rpm.

FIG. 10 shows a flow chart of a routine for setting the desired idling rpm value, executed within the ECU 9 in FIG. 1. This routine is comprised of a block I for setting the desired idling rpm value in dependence on the engine cooling water temperature, a block II for setting the desired idling rpm value in dependence on the on-off state of the air conditioner, a block III for setting the same value in dependence on the on-off state of the automatic transmission, and a block IV for selecting a maximum one of the desired idling rpm values set in the blocks I, II and III.

Figure 11:
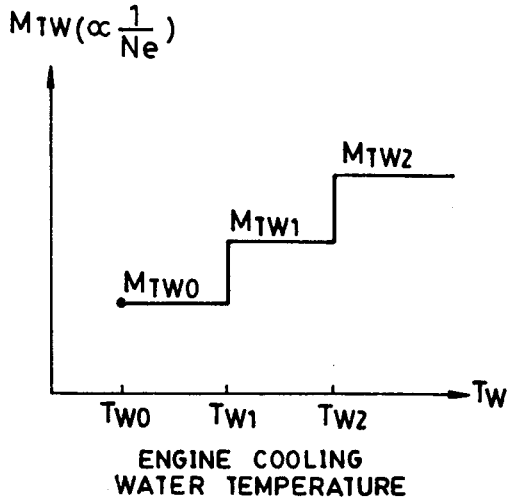
FIG. 11 is a graph showing the relationship between the engine cooling water temperature and a value MTW proportional to the reciprocal of the desired idling rpm dependent upon the engine cooling water temperature.

When the program is called within the ECU 9, at the step 1 in FIG. 10, first a value MTW is determined which is proportional to the reciprocal of the desired idling rpm value and determined by the engine cooling water temperature, at the step 2 The value MTW is set to larger values (smaller values in terms of engine rpm Ne) as the engine cooling water temperature increases, as shown in FIG. 11, for instance. A plurality of predetermined values of the value MTW are previously stored in a map within the ECU 9, as functions of the engine cooling water temperature TW.

Next, a determination is made as to whether or not the switch 15 of the air conditioner is in an on-state, at the step 3. If the result of the determination gives a negative answer, that is, if the air conditioner is inoperative, a provisional value MAC is selected as a value equivalent to a value MTW read at the step 2, at the step 4, and the program proceeds to the step 6. If the result of the determination of the step 3 gives an affirmative answer, that is, if the air conditioner is operative, the provisional value MAC is set to a value MAC0 which is proportional to the reciprocal of engine rpm which is higher by a predetermined increment corresponding to the load of the air conditioner, than normal idling rpm at a standard value (e.g. 70° C.) of the engine cooling water temperature. The above value MAC0 is experimentally determined in advance.

Then, at the step 6, a determination is made as to whether or not the D-range signal of the automatic transmission is being inputted to the ECU 9, that is, whether or not the automatic transmission is in an engaged state. If the answer to this question is negative, a provisional value MAT is selected as a value equivalent to a value MTW read at the step 2, at the step 7, and the program proceeds to the step 8. If the answer to the question of the step 6 is affirmative, that is, when the automatic transmission is engaged and its load is acting upon the engine 1, the provisional value MAT is set to a value MAT0, at the step 9, which is proportional to the reciprocal of engine rpm which is higher by a predetermined increment corresponding to the load of the automatic transmission, than the above normal idling rpm at the standard engine cooling water temperature, the value MAT0 being also previously experimentally determined, followed by the program proceeding to the step 8.

At the step 8, it is determined whether or not the value MTW determined as above is smaller than or equal to the provisional value MAT, and if the answer is no, that is, if the value MTW is larger than the provisional value MAT, a further provisional value MX is set to a value equal to the provisional value MAT, at the step 9, while if the answer is yes, the same value MX is set to a value equal to the value MTW, at the step 10. It will be noted that at the steps 8 through 10, the smaller one of the values MTW and MAT, that is, the larger one of the desired idling rpm values is selected.

In a manner similar to the above, at the step 11, a comparison is made between the provisional value MX and the provisional value MAC, and the smaller one of which is set to a value MFB, at the steps 12 and 13, then terminating execution of the program. That is, in these steps 8 through 13, the smallest one of the values MTW, MAT and MAC, that is, the largest one of the corresponding desired idling rpm values is selected as the value MFB.

Upper and lower limit values MH and ML of the value MFB thus selected are then determined at the step 12 of (b) of FIG. 6. Such upper and lower limits MH, ML are provided for stable control of the idling rpm. The values of the upper and lower limits NH, NL are set to values, respectively, higher and lower than the desired idling rpm value NFB, by predetermined rpm (e.g. 30 rpm) which is dependent upon the operating characteristics of the engine concerned, and then corresponding values MH and ML are determined from the values NH, NL thus set.

Although in the example of FIG. 10, the three loads to be applied on the engine, such as that of the air conditioner, are used, a similar manner of setting of the desired idling rpm can apply to an example in which further loads are involved, besides the above three loads.

Next, detailed explanations will now be given about control of the supplementary air quantity upon a change in the electrical load on the engine during engine rpm control in feedback mode, decelerating mode and accelerating mode, calculations of the duty factor for the valve opening period of the first control valve in such various modes, and control of the fuel quantity immediately after a change in the engine load such as electrical load, by referring to FIGS. 12 through 17.

Figure 12:
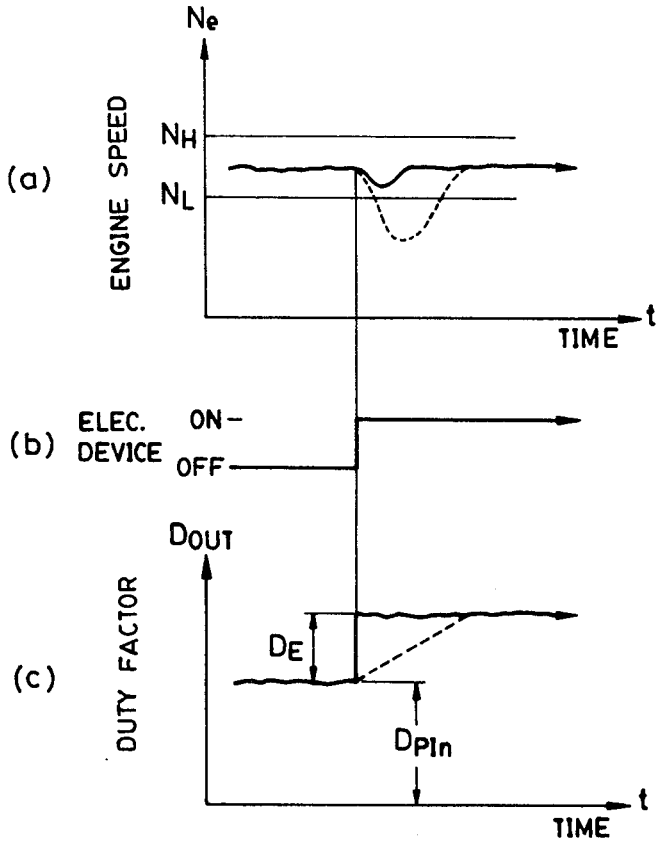
FIGS. 12*a*, 12*b*, and 12*c* are a timing chart showing a manner of control of the first control valve applicable when an electrical load is applied on the engine during feedback control of the engine rpm at engine idle.

Control of Idling RPM in the Event of Addition of an Electrical Load on the Engine Load during Feedback Mode Control FIG. 12 shows a manner of increasing the supplementary air quantity in the event of an electrical load being added to the engine load during feedback mode control of the idling rpm. As shown in (a) of FIG. 12, during engine idle, the engine rpm Ne is controlled in feedback mode so as to be maintained between the upper and lower limits NH, NL of the desired idling rpm range. Let it now be assumed that during this feedback mode control at least one of the switches 21, 22, and 23 of the first, second, and third electrical devices 18, 19 and 20 is closed to apply at least one electrical load on the engine 1, all appearing in FIG. 1, as shown in (b) of FIG. 12. If no countermeasure is taken in such event, the engine rpm Ne will largely drop as indicated by the broken line in (a) of FIG. 12, by an amount corresponding to the magnitude of the added electrical load. Responsive to such drop in the engine rpm Ne, the supply quantity of supplementary air is increased as indicated by the broken line in (c) of FIG. 12, so that with the lapse of time the engine rpm Ne will gradually recover into the desired idling rpm range between the upper and lower limits NH, NL.

Various incremental amounts of supplementary air required for maintaining the engine rpm Ne at the desired idling rpm upon application of an electrical load on the engine (shown as an increment DE of the duty factor for the first control valve 6 in (c) of FIG. 12) can be estimated in advance, depending upon the kinds of the electrical devices which produce such electrical loads. Therefore, various values of the electrical load term DE are determined in advance for respective ones of the electrical devices, and when the on-state signal of one of the electrical devices is inputted to the ECU 9, a corresponding one of the above predetermined electrical load term values DE is selected, at the step 18 in (b) of FIG. 6, and this selected electrical term value DE is added to the feedback mode term DPIN to determine the duty factor DOUT for the first control valve 6, as shown in (c) of FIG. 12.

By increasing the supplementary air quantity upon application of a new electrical load on the engine in the above way, the engine rpm can be promptly recovered to the desired idling rpm, with a greatly reduced response lag in the feedback control ((a) and (c) of FIG. 12).

The duty factor DOUT for the valve opening period of the first control valve 6 applicable during feedback mode control is calculated by the following equation, which is executed at the step 19 in (b) of FIG. 6:

$$DOUT = DPIN + DE \quad (1)$$

where the electrical load term DE is determined at the step 18 in FIG. 6.

Figure 13:
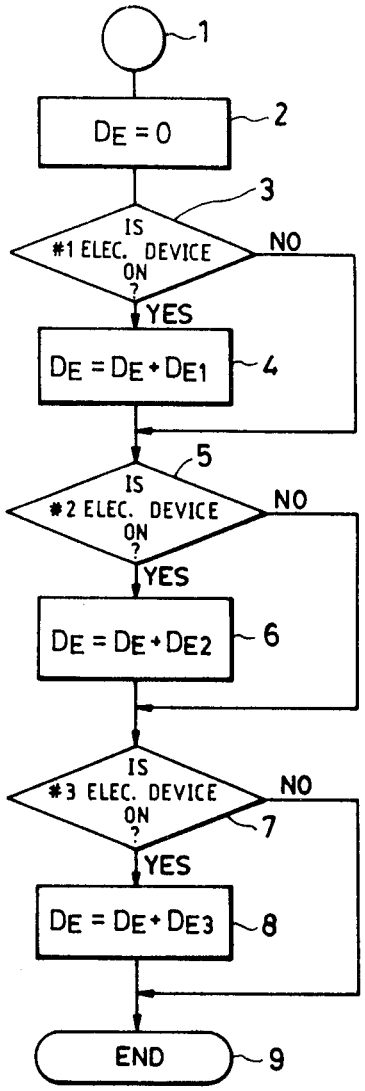
FIG. 13 is a flow chart showing a routine for calculating an electrical load term DE of the duty factor DOUT for the valve opening period of the first control valve, executed within the ECU in FIG. 1.

FIG. 13 shows a flow chart of a subroutine for calculation of the value DE, executed in the step 18 in (b) of FIG. 6. When this program is called at the step 1 in FIG. 13, the stored value of DE is reset to zero at the step 2. Next, at the step 3, it is determined whether or not the switch 21 of the first electrical device 18, shown in FIG. 1, is in on-state. If the answer to this question is no, the program proceeds to the step 5. If, at the step 3, the answer is yes, a predetermined electrical load term $DE_1$ corresponding to the electrical load produced by the first electrical device 18 is added to the stored value of the electrical load term DE and the resulting sum value $DE+DE_1$ is set as a new stored value of electrical load term DE for the first electrical device 18 in the step 4. Since, in this case, the stored value of DE is reset to zero (DE=0) at the step 2, the newly stored value of the electrical load term $DE+DE_1$ is equal to $DE_1$.

Then, in the aforesaid manner, the on-off state of the switch 22 of the second electrical device 19 is determined in the step 5. If it is not in on-state, the program proceeds to the step 7 and if it is in on-state, a predetermined electrical load term $DE_2$ relating to the electrical load produced by the second electrical device 19 is added to the stored value of electrical load term DE, and the resulting sum value $DE+DE_2$ is set as a new stored value of electrical load term DE for the electrical device 19, at the step 6. Further, in the aforesaid manner, the on-off state of the switch 21 of the third electric device 20 is determined at the step 7. If it is not in on-state, the program is terminated at the step 9, and if it is in on-state, a predetermined electrical load term $DE_3$ relating to the third electrical device 20 is added to the stored value of the electrical load term DE and the resulting sum value $DE+DE_3$ is set as a new stored value of electrical load term DE for the electrical device 20 in the step 8, and then execution of the program is terminated.

In the manner explained hereabove, the electrical load term DE in the equation (1) is determined by first determining the respective on-off states of the first, second and third electrical devices 18, 19 and 20 and for each electrical device that is in on-state, a predetermined electrical load term relating to the electrical load produced by the device is added to the stored value of the electrical load term DE, and this new value is set as the updated electrical load term DE.

The value of the feedback mode term DPIN in the above equation (1) is determined, e.g. by a subroutine shown in FIG. 3. The program concerned is called at the step 1 in FIG. 14, and then it is determined whether or not the value Me which is proportional to the reciprocal of the actual engine rpm is smaller than the value MH that corresponds to the upper limit NH of the desired idling rpm range determined at the step 12 in (b) of FIG. 6, at the step 2. If the answer to the question of the step 2 is negative, that is, Ne≦NH, the program proceeds to the step 3, where it is determined whether or not the value of Me is larger than the value of ML, which corresponds to the reciprocal of the lower limit NL of the desired idling rpm range. If the answer to the question of the step 3 is negative, that is, if as a result of the determinations of the steps 2 and 3, the actual engine rpm is found to be between the upper and lower limits NH and NL of the desired idling rpm range, the difference ΔMn between the value Me and the values MH, ML is set to zero at the step 4, since it is then not necessary to either increase or decrease the actual engine rpm Ne. Then, the value of the feedback mode term DPIN is set to a value DPIN−1 obtained in the preceding loop, at the step 5, followed by terminating the execution of the present loop, at the step 6.

If the determination of the step 3 gives an affirmative answer or yes, it is regarded the actual engine rpm Ne is smaller than the lower limit NL, and then the value of the difference ΔMn (which then assumes a positive value or plus sign) is calculated, at the step 7. This value ΔMn is then multiplied by a constant KI to obtain an integral control term value ΔDI, at the step 8. Then, the difference between the difference value ΔMn calculated at the step 7 and the same value ΔMn−1 obtained in the previous loop, that is, the acceleration differential value ΔΔMn, is calculated at the step 9. This acceleration differential value ΔΔMn is multiplied by a constant Kp to obtain a proportional control term value ΔDP at the step 10. The integral control term value ΔDI and the proportional control term value ΔDP, are added to the aforementioned feedback control term value DPIN−1 to obtain a feedback control term value DPIN as an up-to-date value, at the step 11. Then, the execution of the program is terminated at the step 6.

If the answer to the question of the step 2 is affirmative or yes, it is determined that the actual engine rpm Ne is larger than the upper limit NH of the desired idling rpm range, and at the step 12, the above differential value ΔMn is calculated which then assumes a negative value or minus sign. Thence, the integral control term value ΔDI, the proportional control term value ΔDP, and the present loop feedback control term value DPIN are calculated, respectively, at the steps 8, 10 and 11, followed by termination of the execution of the program.

Figure 15:
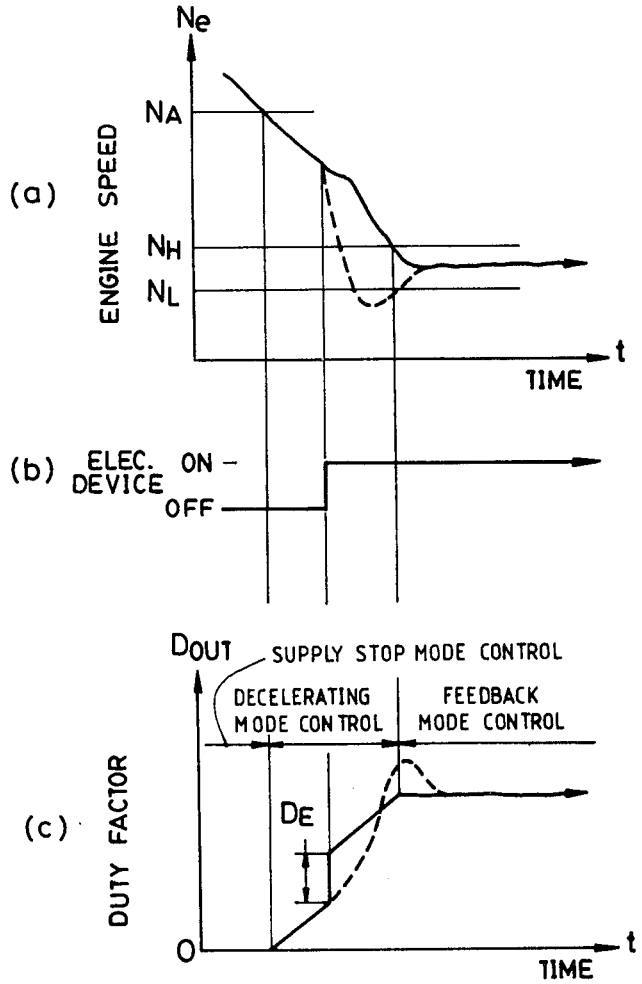
FIGS. 15*a*, 15*b*, and 15*c* are a timing chart showing a manner of control of the first control valve, applicable when an electrical load is applied on the engine during deceleration of the engine with the throttle valve fully closed, wherein the engine rpm decreases toward the feedback control region.

Control of Engine RPM in the Event of Addition of an Electrical Load on the Engine Load during Decelerating Mode Control FIG. 15 shows a manner of control of the supplementary air quantity, applied in the event that an electrical load is applied on the engine during the decelerating mode control as explained previously with reference to FIG. 7.

When the engine rpm decreases with the throttle valve 5 in FIG. 1 fully closed, and falls below the predetermined value of engine rpm NA, the first control valve 6 opens to start the supply of supplementary air to the engine in the decelerating mode control as shown in (a) and (c) of FIG. 15.

When an electrical load is added to the engine load while the engine is in the deceleration mode control, as shown in (b) of FIG. 15, the engine load increases in the same way as during feedback mode control as shown in FIG. 12. On such occasion, despite the supply of gradually increased quantity of supplementary air to the engine in decelerating mode control the quantity of such increased amount of supplementary air can be insufficient causing the engine rpm to abruptly drop as shown by the broken line in (a) of FIG. 15 and depending on the magnitude of the electrical load, can result in engine stall, particularly when the clutch is already in a state of disengagement.

Even when the engine is in decelerating mode control, it is possible to estimate the necessary quantity of supplementary air to be supplied to the engine in proportion to the electrical load that corresponds to the kind of the electrical device, that is in on-state. Therefore, according to the invention, the signal indicative of the on-off state of the electrical devices is monitored, and simultaneously when the signal turns on, the duty factor DOUT of the first control valve 6 is increased by an amount corresponding to the electrical load term DE relating to the electrical device that is switched on, determined as previously explained with reference to FIG. 13 ((c) of FIG. 15 and steps 16 and 17 in (b) of FIG. 6). That is, the duty factor DOUT is determined by the following equation:

$$DOUT = DX + DE \tag{2}$$

where DX is a deceleration mode term which is determined as a function of engine rpm.

In the aforesaid manner, by supplying an increased amount of supplementary air, as calculated by the use of the equation (2), to the engine at the same time as an electrical load is added to the engine load, not only can an abrupt drop in the engine rpm be avoided but the driveability of the engine can also be improved.

Figure 16:
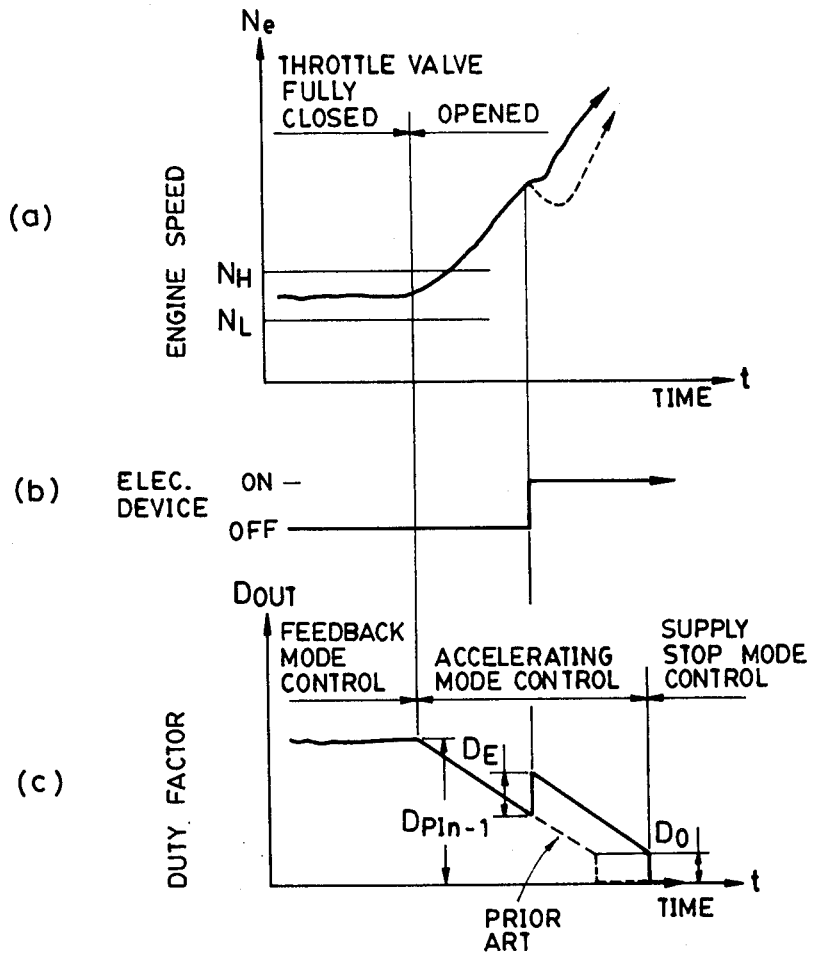
FIGS. 16*a*, 16*b*, and 16*c* are a timing chart showing a manner of the first control valve, applicable when an electrical load is applied on the engine during acceleration of the engine wherein the engine rpm increases from the idling rpm feedback control region.

Control of Engine RPM in the Event of Addition of Electrical Load on Engine Load during Accelerating Mode Control Next, FIG. 16 shows a method for controlling the increase in the quantity of supplementary air to be supplied to the engine, applicable in the event that an electrical load is applied on the engine while the engine is accelerating with the throttle valve 5, shown in FIG. 1, opened from a state of idle in feedback mode control. When the engine is accelerated with the throttle valve 5 fully opened from a state of idle with the throttle valve 5 fully closed in feedback mode control as shown in (a) of FIG. 16, the control of supply of supplementary air is effected in accelerating mode as previously explained with reference to FIG. 9 ((b) of FIG. 16).

Figure 14:
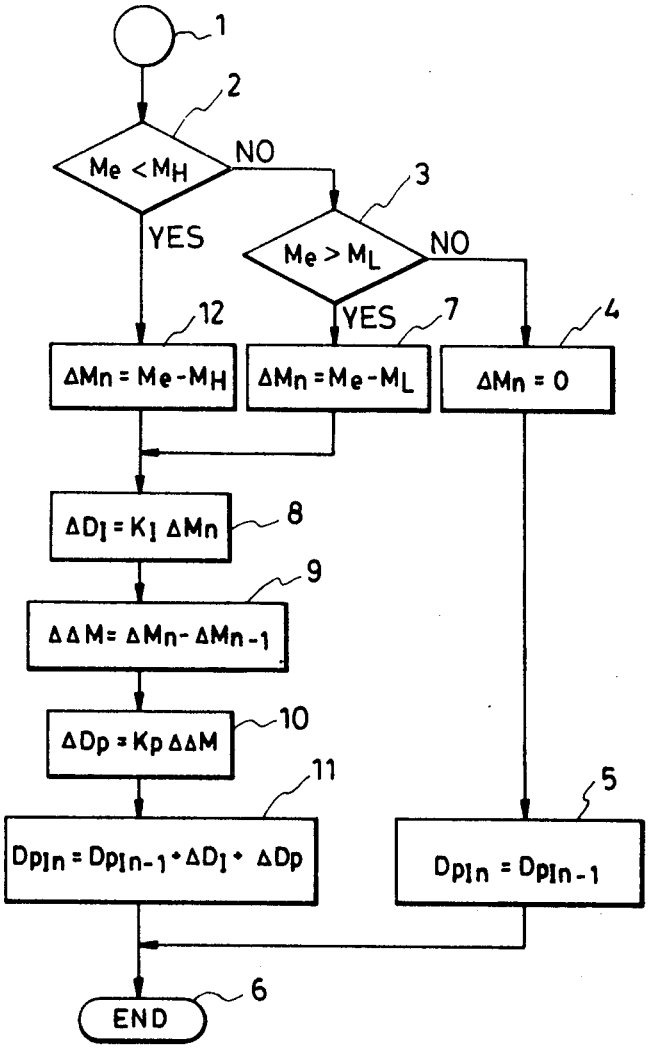
FIG. 14 is a flow chart showing a routine for calculating a feedback control term DPIn of the duty factor DOUT for the valve opening period of the first control valve, applicable during feedback mode control, executed within the ECU in FIG. 1.

If an electrical load is applied on the engine, during the above acceleration mode control of the engine 1((b) in FIG. 16), this electrical load increases the engine load and accordingly the engine rpm Ne abruptly decreases (the broken line in (a) of FIG. 16), causing discomfort to the driver and badly affecting the driveability of the engine, as in the feedback mode control and in the deceleration mode control previously explained with reference to FIG. 12 and FIG. 15, respectively. Even during the acceleration mode control, in the same manner as explained with reference to FIG. 12, it is possible to estimate the necessary quantity of supplementary air supplied to the engine corresponding to each kind of electrical device that produces the electrical load. Therefore, also during this acceleration mode control, the on-state signal of each electrical device indicative of the occurrence of electrical load is monitored, and simultaneously with the output of on-state signal the duty factor DOUT for the control valve 6 is increased just by the electrical load term DE as shown in (c) in FIG. 16. That is, the duty factor DOUT is determined by the following equation:

$$DOUT = DPI_{n-1} - mDA + DE \quad (3)$$

where $DPI_{n-1}$ is a duty factor determined in the last control loop in feedback mode control immediately before the opening of the throttle valve and determined in the manner shown in FIG. 14, DA is a constant determined experimentally, and m indicates the number of pulses of the TDC signal counted from the time the throttle valve 5 is opened. The electrical load term DE is determined in the same manner as previously explained with reference to FIG. 13.

An increased quantity of supplementary air, as calculated by the above equation (3), is supplied to the engine simultaneously with the occurrence of an electrical load on the engine, not only preventing any abrupt drop in the engine rpm but also improving the driveability of the engine.

Manner of Control of Fuel Quantity after a Change in the Engine Load

Details of the manner for controlling the supply of fuel through the fuel injection valve 10 after a change in the engine load including both electrical and mechanical loads during engine rpm control will now be described with reference to FIG. 17. This fuel supply control method corresponds to the manner of setting the value TAIC in the steps 16, 18 and 21 in (b) and (c) of FIG. 6.

Figure 17:
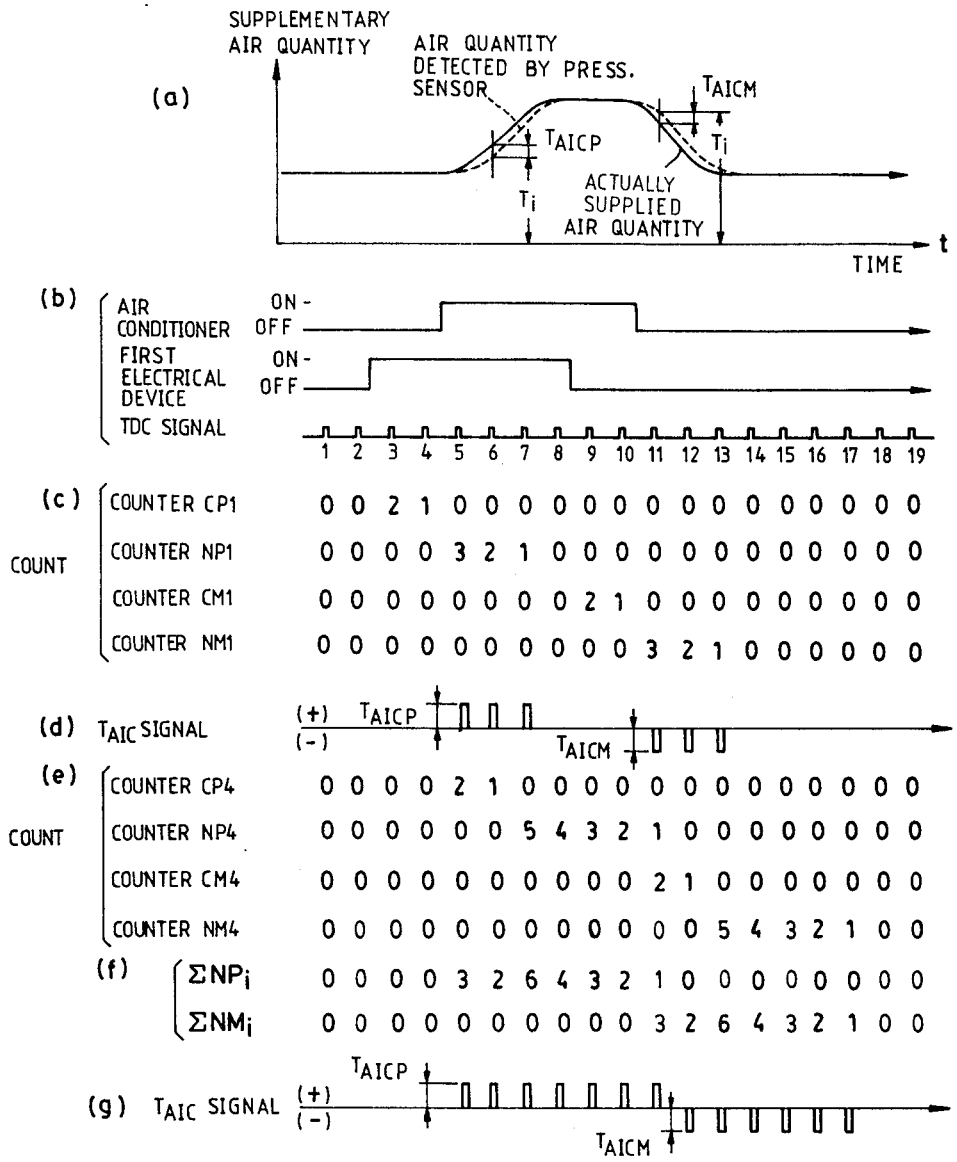
FIGS. 17*a*–*g* are a timing chart showing a manner of controlling the fuel quantity, applicable when a load such as an electrical load is applied on the engine during engine rpm control.

FIG. 17, shows a timing chart of the manner of varying the fuel quantity to be supplied to the engine 1 when there is a change in the operative states of the electrical devices, etc. during control of the idling rpm. For the convenience of explanation, each TDC pulse is numbered in the sequence of generation as a TDC pulse 1, 2, 3 . . . and a first explanation given below is based upon the assumption that during the time between generation of the first TDC pulse 1 and generation of the nineteenth TDC pulse 19, the first electrical device 18 alone is switched on and off, and a second explanation on the assumption that during the time between the generations of the above two pulses, also the air conditioner is switched on and off in addition to the first electrical device 18, respectively.

Let it now be assumed that the first electrical device 18 is switched on at a time between a TDC pulse 2 and a TDC pulse 3 and switched off at a time between a TDC pulse 8 and a TDC pulse 9 ((b) of FIG. 17). The ECU 9 detects a signal indicative of the on-state of the first electrical device 18 immediately after the generation of the TDC pulse 3 and accordingly calculates a value of the duty factor DOUT of the first control valve 6 corresponding to a quantity of supplementary air which is increased by a predetermined amount dependent upon the magnitude of the electrical load on the engine, applied by the first electrical device 18. The first control valve 6 is opened for a valve opening period corresponding to the calculated duty factor DOUT. Similarly, even after generation of a TDC pulse 4, the ECU 9 continuously calculates the above same value of the duty factor DOUT corresponding to the increased supplementary air quantity dependent upon the load of the first electrical device 18, and continuously causes opening of the first control valve 6 for a valve opening period corresponding to the calculated duty factor DOUT until it is supplied with a signal indicative of the off-state of the same device. The increased supplementary air, which is determined and supplied immediately after the generation of the TDC pulse 3 as noted above, actually does not reach a cylinder of the engine 1 until after generation of a TDC pulse 5, as shown in (a) of FIG. 17. This suction delay time is determined by the passage configuration and size of the intake system of the engine, etc. and can be determined theoretically or experimentally. Further, the engine 1 is not supplied with a quantity of fuel which exactly corresponds to the above increased supplementary air until after generation of a TDC pulse 8. This is because the gradual increase of the intake air quantity during the time between the generation of the TDC pulse 5 and the generation of the TDC pulse 8 cannot be accurately detected mainly owing to the detection lag of the absolute pressure sensor 12 ((a) of FIG. 17). Therefore, while the increased air quantity is supplied to the engine 1 from a time immediately after generation of the TDC pulse 5 to a time immediately after generation of the TDC pulse 7, the increase of the fuel supply quantity cannot promptly follow the increase of the intake air quantity, resulting in a shortage in the fuel quantity. Consequently, the mixture supplied to the engine 1 becomes too lean, which can even cause engine stall, hunting of the engine rotation, etc.

Then, an off-state signal indicative of the switching-off of the first electrical device 18 that is switched off at a time between generations of the TDC pulses 8 and 9, is detected immediately after generation of the TDC pulse 9. Since the switching-off of the first electrical device 18 means a reduction in the engine load, a value of the supplementary air quantity is calculated at a time immediately after generation of the TDC pulse 9, which is decreased from the preceding value by a predetermined amount corresponding to the electrical load of the first electrical device 18, and supplied to the engine 1 through the first control valve 6. Also in this event, the decreased supplementary air quantity is not actually supplied to the engine cylinder until after generation of a TDC pulse 11, due to the travel lag attributed to the passage configuration and size of the intake system, etc. Although the intake air quantity gradually decreases during the time between the generation of the a pulse 11 and the generation of the TDC pulse 14, the decreased fuel supply to the engine 1 cannot promptly follow the decrease of the intake air quantity due to the detection lag of the absolute pressure sensor 12, etc., causing supply of an excessive quantity of fuel to the engine and consequent excessive enrichment of the mixture, deteriorating the emission characteristics, and occurrence of hunting of the engine rotation, etc. during idling ((a) and (b) of FIG. 17).

The above-mentioned disadvantages can be eliminated in the following manner: After the supplementary air quantity supplied through the first control valve 6 has been increased immediately after the generation of the TDC pulse 3, and after the lapse of a period between the generation of the TDC pulse 3 and a time immediately before the generation of the TDC pulse 5 (hereinafter called "the fuel increase-delaying period"), the quantity of fuel supplied to the engine 1 is increased by a predetermined amount during the period between a time immediately after the generation of the TDC pulse 5 and a time immediately after the generation of the TDC pulse 7 (this period will be hereinafter called "the fuel increasing period"). On the other hand, after the supplementary air quantity has been decreased immediately after the generation of the TDC pulse 9, and after the lapse of a period between the generation of the TDC pulse 9 and a time immediately before the generation of the TDC pulse 11 (hereinafter called "the fuel decrease-delaying period"), the fuel supply quantity is decreased by a predetermined amount during the period between a time immediately after the generation of the TDC pulse 11 and a time immediately after the generation of the TDC pulse 13 (hereinafter called "fuel decreasing period").

The above manner of increase and decrease of fuel according to the invention will now be described in further detail: Upon detection of an on-state signal from the first electrical device 18, a counter CP1 in the ECU 9 in FIG. 1 has its count set to a predetermined value, 2 for instance, which is determined by the passage configuration and size of the intake system, and other factors, and thenceafter the above newly set count is reduced by 1 upon inputting of each TDC pulse to the ECU 9 ((b) and (c) of FIG. 17). That is, the count in the counter CP1 occurring immediately after the generation of the TDC pulse 4 is set to 1, and the one occurring immediately after the generation of the TDC pulse 5 to 0, respectively. The time during which the count in the counter CP1 is other than 0 corresponds to the aforementioned fuel increase-delaying period, and when the count in the counter CP1 becomes zero, the above fuel increasing period starts. When the count in the counter CP1 becomes zero immediately after the generation of the TDC pulse 5, the count in another counter NP1 in the ECU 9 is set to a predetermined value, 3 for instance, which depends upon the magnitude of the load of the first electrical device 18 on the engine and corresponds to the aforementioned fuel increasing period. At the same time, the valve opening period TOUT of the fuel injection valve 10 is set to a value increased by a predetermined period TAICP corresponding to the detection error of the intake air quantity mainly attributed to the detection lag of the absolute pressure sensor 12. That is, the valve opening period TIOUT of the fuel injection valve 10 is calculated by the following equation:

$$TIOUT = Ti + TAIC \quad (4)$$

where Ti represents a value calculated on the basis of values of engine operation parameter signals from the throttle valve opening sensor 17, the absolute pressure sensor 12, the engine cooling water temperature sensor 13, the engine rpm sensor 14, etc. and TAIC is the aforementioned constant which is set to TAICP during the above fuel increasing period.

The count in the counter NP1 is reduced by 1 upon inputting of each TDC pulse to the ECU 9, and as long as the count NP1 is other than 0, that is, during the period between the generations of the TDC pulses 5 and 7, the above predetermined value TAICP is added to the value Ti of the valve opening period TIOUT of the fuel injection valve 10 upon generation of each of these TDC pulses, and a quantity of fuel corresponding to the calculated valve opening period TIOUT is supplied to the engine 1 ((c) and (d) of FIG. 17). The count in the counter NP1 becomes zero immediately after the generation of the TDC pulse 8 ((c) of FIG. 17), and thereafter the predetermined value TAICP is no longer added to the value Ti of the valve opening period TIOUT (The value TAIC in equation (4) is set to zero). Since by this time the delay time in detecting the changing intake air, i.e. the fuel increasing period has already lapsed, the intake air quantity can then be detected with accuracy ((a), (c) and (d) of FIG. 17), allowing the supply of fuel exactly corresponding to the supplementary air quantity.

Next, when the off-state signal from the first electrical device 18 is detected at a time immediately after generation of the TDC pulse 9, the valve opening period of the first control valve 6 is reduced by a predetermined amount dependent upon the magnitude of the load of the first electrical device 18, and the count in another counter CM1 in the ECU 9 is set to a predetermined value 2 (CM1=2) which corresponds to the aforementioned fuel decrease-delaying period ((b) and (c) of FIG. 17). Then, this count of 2 is reduced by 1 each time each of the following TDC pulses is inputted to the ECU 9. As long as the count in the counter CM1 is other than 0, the above fuel decrease-delaying period still continues, during which neither increase or decrease of the fuel quantity is made by setting and holding the value TAICP at 0 in (4) ((c) and (d) of FIG. 17).

When the count in the counter CM1 becomes zero at a time immediately after the generation of the TDC pulse 11, the count in a counter NM1 in the ECU 9 is set to a predetermined value dependent upon the magnitude of the first electrical device 18 on the engine, 3 for instance which corresponds to the aforementioned fuel decreasing period, and the valve opening period TIOUT of the fuel injection valve 10 is decreased by a predetermined value TAICM, that is, the valve opening period TIOUT is calculated by the use of the equation (4) where the term TAIC is set to −TAICM. The fuel supply is effected on the basis of the resulting calculated value TIOUT. The count in the counter NM1 is reduced by 1 upon inputting of each TDC pulse to the ECU 9, and the period during which the count in the counter NM1 is other than 0 means the above fuel decreasing period. During this period which lasts from a time immediately after the generation of the TDC pulse 11 to a time immediately after the generation of the TDC signal 13, the valve opening period TIOUT is decreased by the predetermined value TAICM to supply a decreased quantity of fuel to the engine ((a), (c) and (d) of FIG. 17).

At a time immediately after generation of the TDC pulse 14, the count in the counter NM1 becomes zero, and thereafter the predetermined value TAICM is no more added to the basic value Ti the valve opening period TIOUT (the value TAIC in the equation (4) is set to zero). Since by this time the intake air detection delay time or the fuel decreasing period has already lapsed so that accurate detection of the intake air quantity is possible, to enable supply of an accurate quantity of fuel to the engine in a manner responsive to the supplementary air quantity ((a), (c) and (d) of FIG. 17).

Next, in addition to the switching-on and -off of the first electrical device 18, let it now be assumed that the air conditioner is switched on at a time between the generation of the TDC pulse 4 and the generation of the TDC pulse 5, and it is switched off at a time between the generation of the TDC pulse 10 and the generation of the TDC pulse 11 ((b) of FIG. 17). The same setting as that referred to previously is applied to the counts in the counters CP1, NP1, CM1 and NM1 related to the first electrical device 18 with respect to each of the TDC pulses ((c) of FIG. 17).

When the air conditioner is switched on, the switch 15 in FIG. 1 operatively connected thereto is closed to cause the supply of a signal indicative of the on-state of the air conditioner to the ECU 9, and simultaneously the second control valve 30 is opened to start supply of an increased quantity of supplementary air responsive to the load on the engine increased by the air conditioner. As previously described with respect to the first electrical device 18, this increased supplementary air quantity is actually sucked into an engine cylinder only after generation of the TDC pulse 7 with a delay of two TDC pulses after the opening of the second control valve 30 (immediately after the generation of the TDC pulse 5 in FIG. 17) in the example of (e) of FIG. 17, due to the suction lag attributed to the passage configuration and size of the intake system between the second control valve 30 and the engine cylinder, etc. Since there is no need of increasing the fuel supply quantity until after the period corresponding to this suction lag or the fuel increase-delaying period lapses, the count in a counter CP4 in the ECU 9 is set to a predetermined value 2 immediately after the generation of the TDC pulse 5, and thereafter this count is reduced by 1 at each of the following TDC pulses. When the count in the counter CP4 is reduced to zero, the count in a counter NP4 is set to a predetermined value, 5 for instance, which corresponds to the fuel increasing period dependent upon the load of the air conditioner. Upon inputting of each TDC pulse, this count is reduced by 1. When the air conditioner is switched off at a time between the generation of the TDC pulse 10 and the generation of the TDC pulse 11, the switch 15 is accordingly closed to cause the second control valve 30 to interrupt the supply of supplementary air to the engine 1. A substantial reduction in the supplementary air quantity occurs due to the above interruption of the supply of supplementary air only after generation of two TDC pulses, i.e. after generation of the TDC pulse 13. To count the period corresponding to this suction time lag, i.e. the fuel decrease-delaying period, the count in a counter CM4 in the ECU 9 is set to a predetermined value 2 at a time immediately after generation of the TDC pulse 11 ((b) and (e) of FIG. 17). Upon inputting of each of the following TDC pulses, the count in the counter CM4 is reduced by 1 and when the count is reduced to zero, the fuel decrease-delaying period terminates. To count the fuel decreasing period, the count in the counter NM4 in the ECU 9 is set to a predetermined value, 5 for instance, which is dependent upon the magnitude of the load of the air conditioner on the engine, followed by reducing the count by 1 at each of the following TDC pulses ((e) of FIG. 17).

In (f) of FIG. 17, the symbol ΣNPi represents a sum of the counts in the counter NP1 related to the first electrical device 18 and the counter NP4 related to the air conditioner occurring at each of the TDC pulses, and the symbol ΣNMi a sum of the counts in the counters NM1 and NM4 occurring at each of the TDC pulses.

As previously noted, the fuel increasing periods dependent upon the respective electrical loads of the first electrical device 18 and the air conditioner last as long as the counts in the respective counters NP1 and NP2 are other than zero. That is, the fuel increasing period dependent upon the combined load of the first electrical device 18 and the air conditioner lasts as long as the sum ΣNPi of the counts in the counters NP1 and NP2 is other than zero. Therefore, at each TDC pulse, this sum ΣNPi is determined, and as long as the determined value assumes a value other than zero, the valve opening period TIOUT of the fuel injection valve 10 is calculated by the use of equation (1) to increase the fuel quantity by the amount TAICP ((f) and (g) of FIG. 17).

Similarly, the sum ΣNMi occurring at each TDC pulse determines the fuel decreasing period dependent upon the combined load of the first electrical device 18 and the air conditioner. As long as the sum ΣNMi assumes a value other than zero, the valve opening period TIOUT of the fuel injection valve 10 is calculated by the use of the equation (4) to decrease the fuel quantity by an amount corresponding to the predetermined period TAICM ((f) and (g) of FIG. 17).

In (f) of FIG. 17, the sum ΣNPi assumes a value of 1 and the sum ΣNMi a value of 3, respectively, at a time immediately after the generation of the TDC pulse 11. That is, the both sums assume values other than zero. On such an occasion, the fuel increase is preferentially effected to prevent engine stall, by setting the value TAIC to TAICP in the equation (4) to increase the fuel quantity by an amount corresponding to the predetermined period TAICP.

Further, it is noted in (f) of FIG. 17 that the counts in the counters NP1 and NP4 are both other than zero at a time immediately after the generation of the TDC pulse 7. Even in such event, the total fuel increasing amount is just an amount corresponding to the single predetermined period TAICP. Likewise, the counts in the counters NMl and NM4 are both other than zero at a time immediately after the generation of the TDC pulse 13, and also on such an occasion, the fuel decreasing amount is limited to an amount corresponding to the single predetermined period TAICM. This is because even if the supply quantity of supplementary air is increased as multiple loads are applied to the engine, the actual correcting amount required for compensation for the detection lag of the absolute pressure sensor 12 is nearly constant irrespective of the magnitude of the intake air quantity as shown in (a) of FIG. 17.

Although the foregoing explanations with reference to FIG. 17 are based upon the assumption that only the first electrical device 18 and the air conditioner are switched on and off, similar explanations may be applied also in the case where additional loads are applied to the engine 1, such as those of the second and third electrical devices 19 and 20, and the automatic transmission, description of which is therefore omitted.

In the above described manner, when there occurs a sudden change in the supplementary air quantity during the feedback control of idling rpm, that is, when the engine is during the fuel increasing period or during the fuel decreasing period, previously explained with reference to FIG. 17, the predetermined value TAIC is added to or subtracted from the aforementioned calculated value Ti as a value corresponding to an amount of deviation from the required fuel quantity mainly attributed to the detection lag of the absolute pressure sensor 12, thereby supplying the engine 1 with a proper amount of fuel fully corresponding to a change in the supplementary air quantity, so as to maintain the air/fuel ratio of the mixture being supplied to the engine at a theoretical value, for instance.

Full Opening Mode Control after Engine Cranking

Next, the manner of controlling the first control valve 6 in full opening mode immediately after completion of engine cranking according to the invention, shown as steps 3 through 7 in (a) of FIG. 6, will now be described.

When the answer to the question of the step 3 in (a) of FIG. 6 becomes negative for the first time after the start of the engine, that is, when the engine rpm Ne becomes higher than the cranking rpm NeCR for the first time after the start of the engine, then the step 6 is executed only on condition that an affirmative answer is obtained that the engine was cranking in the preceding loop, at the step 5. In this step 6, the period of time tIU during which the supplementary air is to be supplied to the engine in full opening mode continuously from the termination of engine cranking, is determined as function of engine cooling water temperature, for instance, in accordance with the engine temperature-value tIU relationship of FIG. 18. In (a) of FIG. 6, it is determined at the step 7 whether or not the determined period of time tIU has passed from the termination of the engine cranking. The duty factor for the valve opening period of the first control valve 6 is maintained at 100 percent after the termination of the engine cranking until the period of time tIU lapses.

Figure 18:
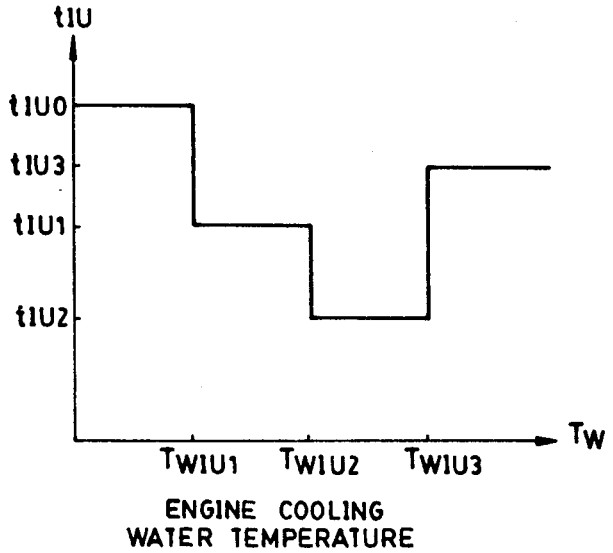
FIG. 18 is a graph showing the relationship between a period of time for which the first control valve continues to be fully opened from termination of the engine cranking to thereby supply a maximum amount of supplementary air to the engine, and the engine cooling water temperature which determines the same period.

In the example of FIG. 18, the value tIU is set to and maintained at a fixed value tIU0 (e.g. 5 seconds) below a predetermined value TWIU1 (e.g. 40° C.) of the engine cooling water temperature TW. As the engine cooling water temperature increases, the period of time tIU is stepwise reduced. During the idling operation, the engine rpm is maintained at a value higher than the desired idling rpm, by thus supplying supplementary air to the engine in full opening mode even after the termination of engine cranking for a suitable period of time tIU, thereby avoiding unstable rotation of the engine due to the operation of the dynamo or generator of the engine for charging the battery. Further, since the idling rpm is set to higher values as the engine temperature becomes lower, the temperature of the engine cylinder wall can be promptly increased by the increase of idling engine rpm dependent upon the engine temperature to achieve stable combustion within the engine cylinders.

Further, in the event of presence of bubbles in the feeding pipes of the fuel feeding system, which makes the idling operation unstable and will occur in a high temperature atmosphere, for instance, when the engine cooling water temperature is higher than a predetermined value TWIU3, e.g. 80° C., the full opening period of time tIU is set to a value tIU3 which is rather large, for instance, 4 seconds, at engine idle, thereby removing the bubbles promptly for stable rotation of the engine.

Although according to the example of FIG. 18, the period of time tIU is varied in a stepwise manner with respect to a change in the engine cooling water temperature, the functional relationship between the value tIU and the engine cooling water temperature is not limited to that of the illustrated example, but it may vary depending upon the operating characteristics of the engine concerned, for instance, the period of time tIU may be linearly varied as a function of the engine cooling water temperature.

Figure 19A:
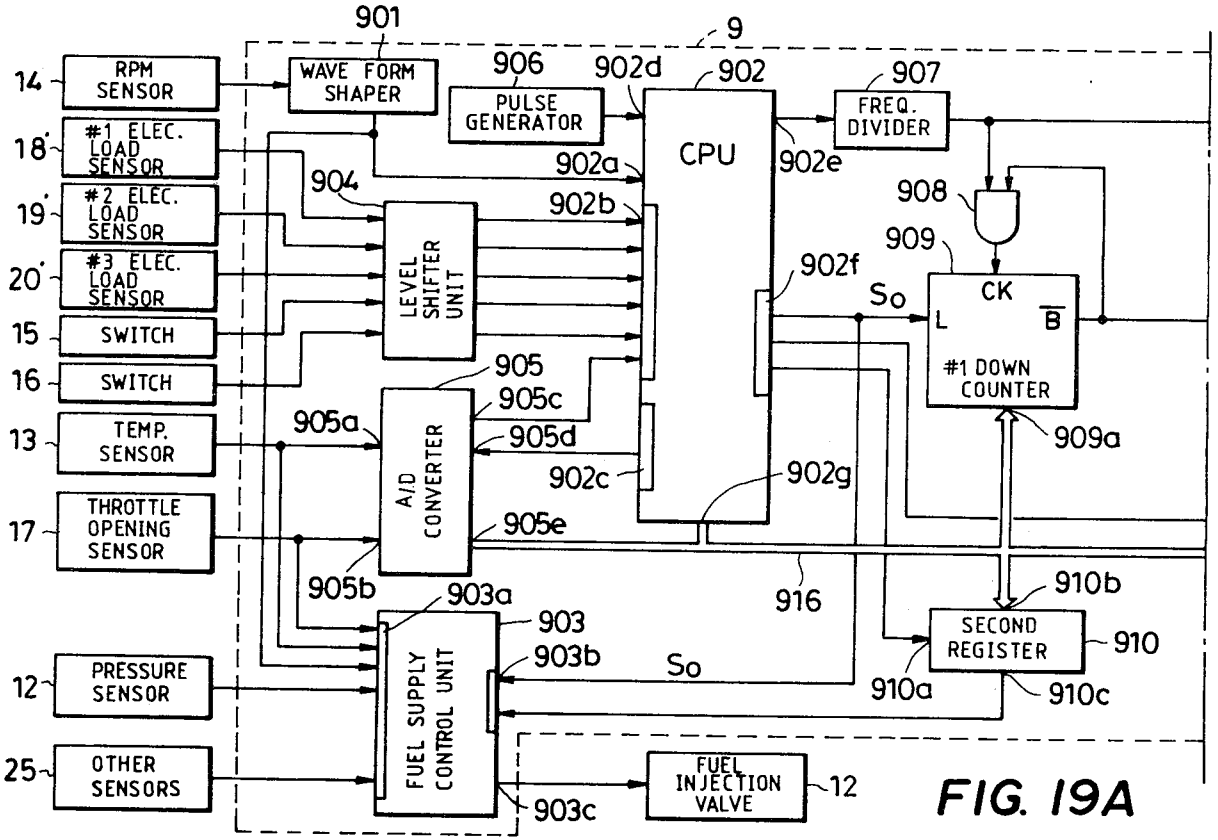
FIGS. 19, 19A and 19B are a circuit diagram illustrating an electrical circuit within the ECU in FIG. 1.
Figure 19B:
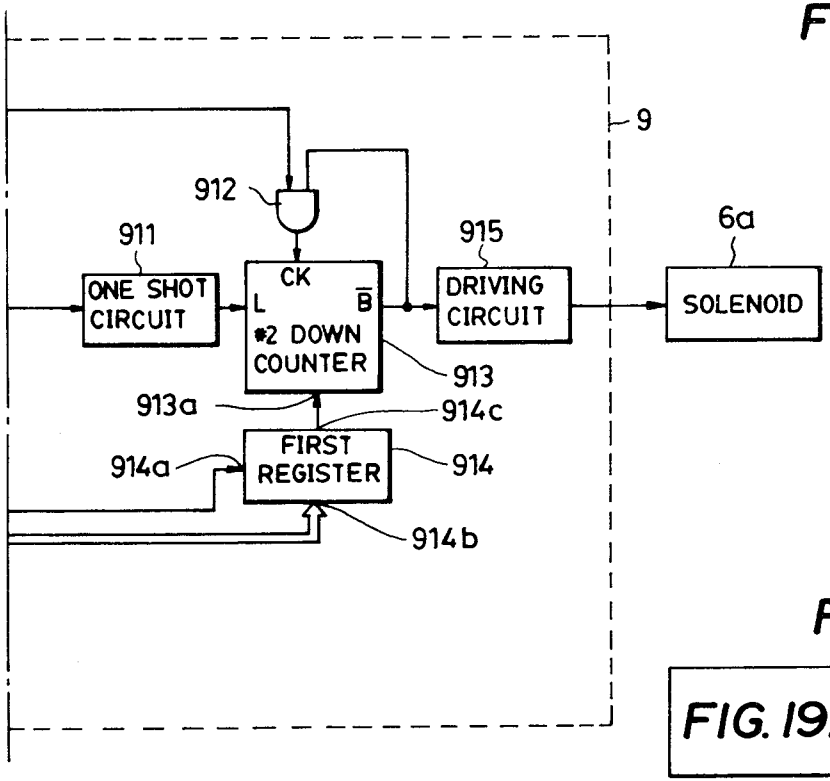
Figure 19:
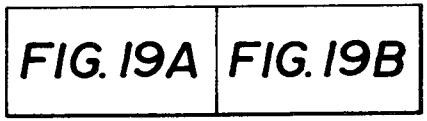

Next, the electrical circuit within the ECU 9 will now be explained by referring to FIG. 19 illustrating the same circuit by way of example.

The engine rpm sensor 14 in FIG. 1 is connected to an input terminal 902*a* of a one chip CPU (hereinafter merely called "CPU") 902 by way of a waveform shaper 901, and also to a group of input terminals 903*a* of a fuel supply control unit 903, all provided within the ECU 9. Reference numerals 18', 19' and 20' designate sensor means for detecting the electrical loads of the electrical devices 18, 19 and 20 in FIG. 1, which are connected to respective ones of a group of further input terminals 902*b* of the CPU 902 by way of a level shifter unit 904 in the ECU 9. Further, the switches 15 and 16 are connected to the above input terminals 902*b* of the CPU 902 by way of the level shifter unit 904. The water temperature sensor 13 and the throttle valve opening sensor 17 are connected, respectively, to input terminals 905*a* and 905*b* of an analog-to-digital converter 905 and are also both connected to the input terminals 903*a* of the fuel supply control unit 903. The analog-to-digital converter 905 has an output terminal 905*c* connected to the input terminals 902*b* of the CPU 902 and a group of further input terminals 905*d* connected to a group of output terminals 902*c* of the CPU 902. A pulse generator 906 is connected to another input terminal 902*d* of the CPU 902 which in turn has an output terminal 902*e* connected to AND circuits 908 and 912 at their one input terminals, by way of a frequency divider 907. The AND circuit 908 has its output connected to a clock pulse input terminal CK of a first down counter 909. The AND circuit 908 has its other input terminal connected to a borrow output terminal $\overline{B}$ of the first down counter 909 which terminal is further connected to a load input terminal L of a second down counter 913 by way of a one shot circuit 911. The first down counter 909 has its load input terminal L connected to a first one of another group of output terminals 902*f* of the CPU 902. The above first one output terminal is also connected to another group of input terminals 903*b* of the fuel supply control unit 903. The AND circuit 912 has its output connected to a clock pulse input terminal CK of the second down counter 913, and its other input terminal to a borrow output terminal $\overline{B}$ of the same counter 913, respectively. The borrow output terminal $\overline{B}$ of the second down counter 913 is also connected to the solenoid 6*a* of the control valve 6 in FIG. 1 by way of a solenoid driving circuit 915. A second one of the output terminals 902*f* of the CPU 902 is connected to an input terminal 914*a* of a first register 914 which in turn has its output terminal 914*c* connected to an input terminal 913*a* of the second down counter 913. Another one of the output terminals 902*f* of the CPU 902 is connected to the input terminal 910 of the second register 910 which has its output terminal 910*c* connected to the group of input terminals 903*b* of the fuel supply control unit 903.

The analog-to-digital converter 905, the CPU 902, the first register 914, the second register 910 and the first down counter 909 are connected together by way of a data bus 916, respectively, at an output terminal 905*e*, an input and output terminal 902*g*, an input terminal 914*b*, an input terminal 910*b*, and an input terminal 909*a*.

Connected to the input of the fuel supply control unit 903 are the intake air pressure or absolute pressure sensor 12 and the other engine parameter sensor 25 such as an atmospheric pressure sensor, all appearing in FIG. 1. The output terminal 903*c* of the fuel supply control unit 903 is connected to the fuel injection valve 10 in FIG. 1.

The electrical circuit of the ECU 9 constructed above operates as follows: An output signal from the engine rpm sensor 14 is supplied to the ECU 9 as a signal indicative of engine rpm Ne as well as a signal indicative of a top dead center of the engine 1, where it is subjected to waveform shaping by the waveform shaper 901 and then supplied to the CPU 902 and the fuel supply control unit 903. The CPU 902 is responsive to each pulse of the TDC-synchronous signal to generate and supply a chip selecting signal, a channel selecting signal, an analog-to-digital conversion starting signal, etc. to the analog-to-digital converter 905, commanding the latter to convert analog signals such as the engine cooling water temperature signal and the throttle valve opening signal from the cooling water temperature sensor 13 and the throttle valve opening sensor 17 into corresponding digital signals. When the A/D converter 905 generates through its output terminal 905*c* a signal indicative of completion of the analog-to-digital conversion of one of the analog signal, the digitally converted signal indicative of engine cooling water temperature or throttle valve opening is supplied as a data signal to the CPU 902 via a data bus 916. Upon completion inputting of one of such digitally converted signals to the CPU 902, the same process as above is repeated to cause inputting of the other digitally converted signal to the CPU 902. Further, load-indicative signals from the electrical load sensor means 18', 19' and 20' and on-off state signals from the switches 15 and 16 are supplied to the CPU 902 after having their levels shifted to a predetermined level by the level shifter unit 904.

The CPU 902 operates on input data signals, that is, the engine rpm signal, the electrical load signals, the mechanical load signals, the engine water temperature signal and the throttle valve opening signal to first determine operating conditions of the engine. More specifically, as previously stated, the CPU 902 determines that the engine should be operating in full opening mode when the engine rpm Ne indicated by the engine rpm signal is smaller than the cranking rpm NeCR and also when the period of time tIU does not yet lapse after the engine rpm Ne has exceeded the cranking rpm NeCR, and the engine should be operating in decelerating mode when the throttle valve opening signal shows a value indicative of the full closing of the throttle valve and simultaneously the engine rpm Ne indicated by the engine rpm signal shows a value smaller than the predetermined rpm NA, respectively. Responsive to the results of the above determination, the CPU 902 calculates the valve opening delaying period of time TDLY and the valve opening period TOUT for the first control valve 6, and the value TAIC in the equation (4) for the fuel injection valve 10.

Figure 20:
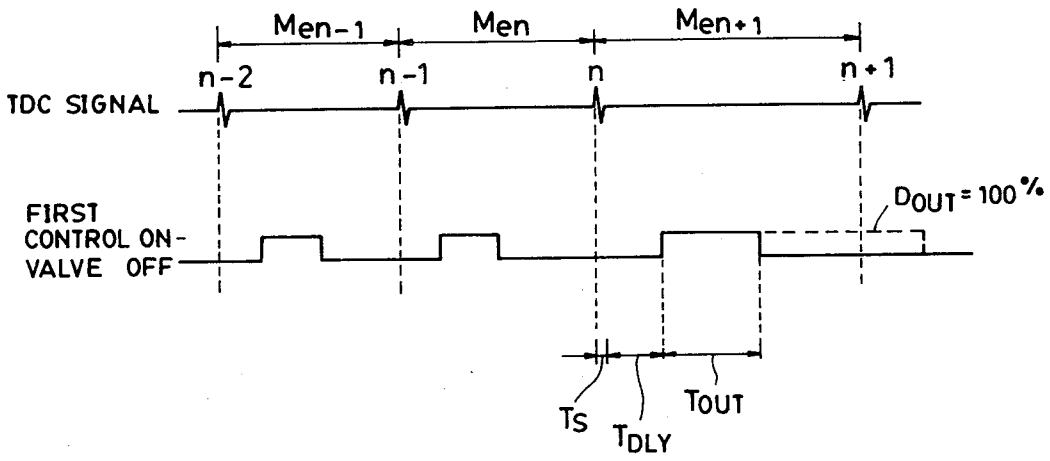
FIG. 20 is a timing chart showing the timing relationship between pulses of the TDC signal and the valve opening of the first control valve.

The manner of calculating the above periods TDLY, TOUT will now be described in detail with reference to FIG. 20. In FIG. 20, when an nth pulse of the TDC signal is inputted to the CPU 902, operations are carried out within a period of time Ts from the above inputting of the TDC signal pulse, which include reading of the aforementioned data signals into the CPU 902, arithmetic calculations of the valve opening delaying period TDLY and valve opening period TOUT of the first control valve 6 and supply of the resulting calculated values from the CPU 902 to the first down counter 909 and the first register 914. After these operations are over, the first control valve 6 is opened upon a lapse of the calculated valve opening delaying period TDLY for the calculated period of time TOUT. As noted above, exactly saying, the valve opening delaying period applied after the inputting of each TDC signal pulse is equal to Ts+TDLY. The period Ts consisting of the data reading period and the arithmetic calculating period has a nearly constant value and is applied upon inputting of each pulse of the TDC signal to the CPU 902 at substantially constant intervals of time. Therefore, the valve opening delaying period TDLY alone is calculated upon inputting of each pulse of the TDC signal.

The valve opening delaying period TDLY and the valve opening period TOUT can be determined by the following equations:

$$TDLY = DDLY/100 \times \text{Men} \quad (5)$$

$$TOUT = DOUT/100 \times \text{Men} + \text{To} \quad (6)$$

In the above equations, Men represents a time interval from inputting of an (n−1)th pulse of the TDC signal to inputting of the nth pulse of same, and the value of Me is inversely proportional to the engine rpm Ne, that is, it decreases as the engine rpm Ne increases. As expressed by the equations (5) and (6), the valve opening delaying period TDLY and the valve opening period TOUT are determined by multiplying the value of Me by constants DDLY and duty factor DOUT (in percentage), respectively. Although the calculations of the values TDLY and TOUT applicable after inputting of the present nth pulse of the TDC signal should be made by using the corresponding time interval Men+1 to obtain exact calculated values, the value of Men+1 is not yet known at the time of calculating the present values TDLY and TOUT and the value Men+1 is nearly equal to the value of Men applied in the previous loop. Therefore, the value of Men is used for calculating the values TDLY and TOUT.

In the equation (5), as previously stated, the coefficient DDLY is a constant which has its value dependent upon the configuration of the intake pipe of an engine applied, etc. and experimentally determined for each engine applied. It is set at a value so as to make the phase of the fluctuating cycle of the intake pipe absolute pressure always constant with respect to generation of each pulse of the TDC signal, for instance, it is set at 25 percent.

In the equation (6), as previously stated, the duty factor DOUT is a variable which has its value determined upon inputting of each pulse of the TDC signal and as a function of engine rpm, engine cooling water temperature, electrical loads, etc. It is set to appropriate values so as to control the idling rpm to a value appropriate for the engine load at idle. To is a constant representing a dead period of time corresponding to the response lag of the first control valve 6, or a like factor, and is set at 7 ms, for instance.

During full opening mode control according to the invention, the duty factor DOUT is set to 100 percent, that is, the first control valve 6 is continuously opened during full opening mode control. More specifically, as indicated by the broken line in FIG. 20, the control valve 6 is kept opened even after generation of an (n+1)th TDC pulse until the determined period of time tIU lapses.

Data indicative of the values TDLY and TOUT calculated by the equations (5) and (6) are generated from the CPU 902 and loaded into the first down counter 909 through the data bus 916 upon inputting of a reading command signal to their input terminals 909*a* and 914*a*. That is, the valve opening delaying period TDLY is loaded into the first down counter 909, and the valve opening period TOUT into the first register 914, respectively.

Clock pulses generated by the pulse generator 906 are used as a reference signal for control of the operation of the CPU 902, while they are subjected to frequency division into a suitable frequency by the frequency divider 907, and then applied to the AND circuits 908 and 912 at their one input terminals.

The CPU 902 applies a starting command signal to the first down counter 909 at its load input terminal L upon the lapse of the period Ts after inputting of each pulse of the TDC signal to the CPU 902. Upon being supplied with this starting command signal, the first down counter 909 is loaded with the calculated valve opening delaying period value TDLY and at the same time generates a high level output of 1 at its borrow output terminal B and applies it to the AND circuit 908 at its other input terminal.

As long as the AND circuit 908 has its other input terminal supplied with the above high level output of 1, it allows clock pulses applied to its one input terminal to be applied to the first down counter 909 at its clock pulse input terminal CK. The first down counter 909 counts clock pulses until the count reaches a value corresponding to the calculated value of the valve opening delaying period TDLY for the first control valve 6. Upon counting the above value, the first down counter 909 generates a low level output of 0 through its borrow output terminal $\overline{B}$ to close the AND circuit 908 to cause interruption of application of clock pulses to the first down counter 909.

The one shot circuit 911 applies a starting command pulse to the second down counter 913 at its load input terminal L each time it is supplied with the above low level output from the first down counter 909. That is, the above starting command pulse is applied to the second down counter 913 upon completion of the counting of clock pulses corresponding in number to the calculated valve opening delaying period TDLY by the first down counter 909.

Upon being supplied with the starting command pulse from the one shot circuit 911, the second down counter 913 is loaded with the calculated valve opening period value TOUT from the first register 914, and at the same time generates a high level output of 1 at its borrow output terminal $\overline{B}$ and applies it to the AND circuit 912 at its other input terminal and also to the solenoid driving circuit 915. The solenoid driving circuit 915 operates to cause energization of the solenoid 6*a* of the first control valve 6 in FIG. 1 for supply of supplementary air to the engine 1 as long as it is supplied with the above high level signal of 1 from the second down counter 913.

While the AND circuit 912 has its other input terminal supplied with the high level signal of 1, it allows clock pulses applied to its one input terminal to be applied to the clock pulse input terminal CK of the second down counter 913. In a manner similar to the operation of the first down counter 909, the second down counter 913 continuously generates a high level ouput of 1 through its borrow output terminal B until it is supplied with clock pulses corresponding in number to the calculated valve opening period TOUT, and upon counting clock pulses corresponding in number to the value TOUT, it generates a low level output of 0 through the same terminal $\overline{B}$ to cause the solenoid driving circuit 915 to deenergize the solenoid 6*a* of the first control valve 6. At the same time, the above low level output of the second down counter 913 is also supplied to the AND circuit 912 to interrupt the application of clock pulses to the second down counter 913.

As is often the case with the full opening mode control according to the invention where the duty factor DOUT is set to 100 percent, for instance, the phenomenon can take place that before a counting of the valve opening period TOUT is terminated in the second down counter 913, a next starting command signal from the first down counter is applied to the load input terminal L of the second down counter 913 through the one shot circuit 911. In such event, the second down counter 913, upon being supplied at its load input terminal L with the above next starting command signal, gets loaded with a new calculated and stored value of the valve opening period TOUT from the first register 914 to start counting a number of clock pulses corresponding to the newly loaded value. Therefore, in such event, the solenoid 6*a* of the first control valve 6 is kept energized by means of the solenoid driving circuit 915, that is, kept in its fully opened state.

On the other hand, the value TAIC in the equation (4), calculated by the CPU 902, is supplied to the second register 910 through the data bus 916, upon a loading command signal being applied to its input terminal 910*a* from the CPU 902.

On the other hand, the fuel supply control unit 903 operates on engine operation parameter signals supplied from the engine rpm sensor 14, the engine water temperature sensor 13, the throttle valve opening sensor 17, the absolute pressure sensor 12, and the other engine operation parameter sensors 25, which are sequentially supplied to the same unit 903 in synchronism with the TDC signal, to calculate a desired value of the valve opening period Ti in accordance with the equation (1), upon inputting of each TDC pulse to the unit 903. The starting command signal So, which is supplied to the first down counter 909, is also supplied to the fuel supply control unit 903 to cause inputting of the calculated value TAIC stored in the second register 910 thereto. The above command signal So also causes the fuel supply control unit 903 to calculate a value of the valve opening period TIOUT by adding the input value TAIC to the above calculated value Ti, to cause the fuel injection valve 10 to open for the calculated valve opening period.

Although the foregoing embodiment is directed to an internal combustion engine equipped with an automatic transmission, the method of the invention may of course be applied to an internal combustion engine equipped with a manual transmission, providing the same results as described above.

What is claimed is:

1. A method for controlling a control valve for regulating the quantity of supplementary air being supplied to an internal combustion engine, in a feedback manner responsive to the difference between actual engine rpm and desired idling rpm during idling of the engine, the method comprising the steps of: (a) detecting engine rpm at the start of the engine; and (b) opening said control valve to a maximum opening for a predetermined period of time from the time the engine rpm is detected to have increased above a predetermined value lower than said desired idling rpm, whereby the engine rpm is maintained at a value higher than said desired idling rpm.

2. A method as claimed in claim 1, including the step of setting said predetermined period of time to values as a function of the temperature of the engine.

3. A method as claimed in claim 2, including the step of detecting the temperature of the engine immediately after the engine rpm has increased above said predetermined value of engine rpm.

4. A method as claimed in claim 2, wherein said predetermined period of time is set to larger values as the temperature of the engine decreases below a predetermined value and further becomes lower.

5. A method as claimed in claim 2, wherein said predetermined period of time is set to larger values as the temperature of the engine increases above a predetermined value and further becomes higher.

* * * * *